US009228804B2

(12) United States Patent
Syrengelas et al.

(10) Patent No.: US 9,228,804 B2
(45) Date of Patent: Jan. 5, 2016

(54) MODULAR FIREARM FOREND

(71) Applicant: SureFire, LLC, Fountain Valley, CA (US)

(72) Inventors: George Syrengelas, Garden Grove, CA (US); Ronald S. Gibson, Valencia, CA (US); Michael D. Picciotta, Yorba Linda, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/739,549

(22) Filed: Jan. 11, 2013

(65) Prior Publication Data

US 2014/0196342 A1 Jul. 17, 2014

(51) Int. Cl.

| | |
|---|---|
| ***F41C 23/16*** | (2006.01) |
| ***F41G 1/34*** | (2006.01) |
| ***F41C 7/02*** | (2006.01) |
| ***F41G 1/35*** | (2006.01) |

(52) U.S. Cl.

CPC . *F41G 1/345* (2013.01); *F41C 7/02* (2013.01); *F41C 23/16* (2013.01); *F41G 1/35* (2013.01); *Y10T 29/49826* (2015.01); *Y10T 156/10* (2015.01)

(58) Field of Classification Search

CPC ..... F41C 7/02; F41C 23/16; F41G 1/345; F41G 1/35

USPC ..... 42/71.01, 71.02, 72, 73, 74, 114, 117, 42/146; 89/1.42; 362/110

See application file for complete search history.

(56) References Cited

U.S. PATENT DOCUMENTS

| | | | | | |
|---|---|---|---|---|---|
| 2,587,921 | A | * | 3/1952 | Suite | 42/71.01 |
| 2,597,565 | A | * | 5/1952 | Chandler et al. | 362/110 |
| 2,826,848 | A | * | 3/1958 | Davies | 42/71.01 |
| 3,739,167 | A | * | 6/1973 | Avery | 362/157 |
| 3,813,795 | A | * | 6/1974 | Marshall et al. | 434/22 |
| 4,777,754 | A | | 10/1988 | Reynolds, Jr. | |
| 4,856,218 | A | | 8/1989 | Reynolds, Jr. | |
| 5,027,542 | A | * | 7/1991 | Simonetti | 42/72 |
| 5,417,002 | A | * | 5/1995 | Guerra | 42/72 |
| 5,430,967 | A | | 7/1995 | Woodman, III et al. | |
| 5,685,105 | A | * | 11/1997 | Teetzel | 42/146 |
| 5,727,346 | A | * | 3/1998 | Lazzarini et al. | 42/146 |
| 5,913,669 | A | * | 6/1999 | Hansen et al. | 42/146 |

(Continued)

OTHER PUBLICATIONS

Remington Law Enforcement, (c) 2010, Published on the web at: http://www.remingtonle.com/shotguns/870synthetic.htm, pp. 1-3.*

(Continued)

*Primary Examiner* — Bret Hayes

(74) *Attorney, Agent, or Firm* — Haynes and Boone, LLP

(57) ABSTRACT

In one embodiment, a forend for a firearm includes an adapter module configured to mount below a barrel and in front of a receiver of a specific model of a firearm, such as a shotgun, and a universal firearm accessory module coupled to one or more surfaces of the adapter module. The adapter module can include an upper surface that substantially conforms to a lower surface of the barrel, a longitudinal bore configured to receive a tubular magazine of the firearm concentrically therein, and lower and external side surfaces defining a plug. The accessory module can include a firearm accessory and an upper and internal side surfaces defining a socket configured to receive the plug of the adapter module in a complementary plug-in engagement. The accessory can be a source of a light useful for illuminating a target or aiming the firearm.

32 Claims, 23 Drawing Sheets

(56) References Cited

U.S. PATENT DOCUMENTS

| | | | | |
|---|---|---|---|---|
| 6,374,528 | B1 * | 4/2002 | Davis et al. | 42/71.01 |
| 6,526,688 | B1 | 3/2003 | Danielson et al. | |
| 6,655,069 | B2 * | 12/2003 | Kim | 42/114 |
| 6,658,779 | B2 | 12/2003 | Bauer et al. | |
| 6,782,652 | B1 * | 8/2004 | Erickson | 42/143 |
| 6,931,775 | B2 * | 8/2005 | Burnett | 42/72 |
| 7,188,978 | B2 | 3/2007 | Sharrah et al. | |
| 7,493,722 | B2 | 2/2009 | Howe et al. | |
| 7,591,098 | B2 | 9/2009 | Matthews et al. | |
| D628,323 | S | 11/2010 | Matthews et al. | |
| D628,324 | S | 11/2010 | Matthews et al. | |
| 8,371,056 | B1 * | 2/2013 | Baker et al. | 42/90 |
| 8,371,729 | B2 | 2/2013 | Sharrah et al. | |
| 2003/0106251 | A1 * | 6/2003 | Kim | 42/71.01 |
| 2004/0226212 | A1 * | 11/2004 | Shiloni | 42/96 |
| 2005/0115140 | A1 * | 6/2005 | Little | 42/118 |
| 2006/0207152 | A1 * | 9/2006 | Lazor | 42/71.01 |
| 2007/0137087 | A1 * | 6/2007 | Florea et al. | 42/90 |
| 2009/0122527 | A1 * | 5/2009 | Galli | F41G 11/003 362/110 |
| 2009/0178325 | A1 * | 7/2009 | Veilleux | 42/117 |
| 2009/0313872 | A1 * | 12/2009 | Goertz | 42/69.01 |
| 2011/0119982 | A1 * | 5/2011 | Webber et al. | 42/75.03 |
| 2012/0005930 | A1 * | 1/2012 | Cragg | 42/1.06 |
| 2012/0266514 | A1 * | 10/2012 | Michal et al. | 42/90 |

OTHER PUBLICATIONS

U.S. Appl. No. 29/441,969, filed Jan. 11, 2013, inventors: Gibson et al., 10 pages.

"Tactical Products Catalog 2008," SureFire LLC, Fountain Valley, CA, pp. 36-40.

* cited by examiner

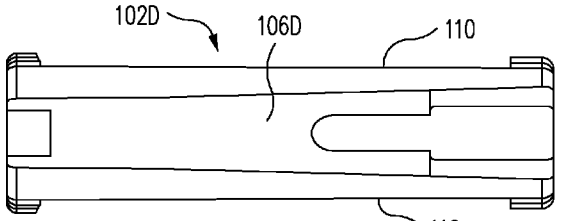
FIG. 9B
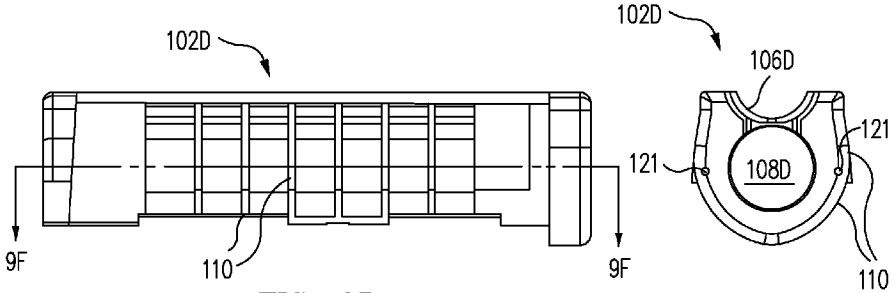
FIG. 9E
FIG. 9D
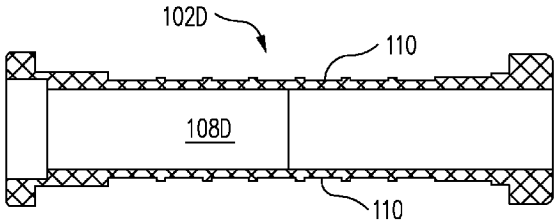
FIG. 9F
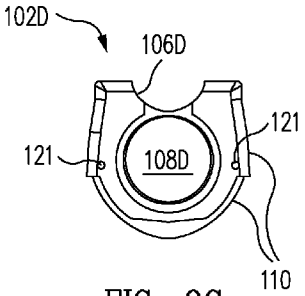
FIG. 9C

MODULAR FIREARM FOREND

BACKGROUND

1. Technical Field

This invention relates to firearms in general, and in particular, to modular fore-end grips, or "forends," for firearms that are contoured as an accessory-mounting handgrip and useful for gripping and aiming the firearm.

2. Related Art

Long guns, such as rifles and shotguns, typically include two gunstock portions, viz., a buttstock or shoulder stock portion, located at the rear end of the gun, which the shooter grasps with one hand and places against a shoulder during the aiming and firing of the gun, and a forend portion, which is typically located below the barrel of the gun and ahead of its receiver, which the shooter grasps with the other hand and uses to support the barrel and to traverse it in azimuth and elevation, i.e., to aim the gun. In some guns, the shoulder stock and forend of long guns are merged into a single continuous piece, and in others, the forend comprises a separate piece that, in some embodiments, e.g., such as pump-action shotguns and rifles, is slid rearward and then forward on the gun to extract spent shells from the gun and to chamber fresh ones in it. Handguns, such as pistols, typically do not incorporate a forend, but do include one or more handgrips located at a rear portion of the gun on either side of or surrounding a downwardly protruding butt or magazine portion thereof.

Accordingly, over time, the market has seen offerings of a number of accessory-mounting forends for both handguns and long guns. For example, firearm forends incorporating light beam aim-assisting devices for both handguns and long guns are described in U.S. Pat. Nos. 4,777,754 and 4,856,218, both of which are hereby incorporated by reference in their entirety.

Some prior art forends are not without some drawbacks. For example, they are typically configured for and can be used only on a specific model of firearm. Thus, if a user wishes to obtain the same functionality provided by the forend on a different model of firearm, he or she must purchase another complete forend that is specifically configured for use on that model.

Another drawback of some prior art forends relates to their chirality, i.e., they are typically configured for use, particularly their actuating switches, by either a right-handed shooter or a left-handed shooter, but not both, i.e., they lack ambidexterity. Another drawback is that some prior art forends are typically relatively monolithic in construction, with the result that access to the accessory portion of the forend, e.g., for battery replacement or wiring replacement or repair can be difficult.

SUMMARY

In accordance with embodiments of the present disclosure, modular, accessory-mounting forends for firearms are provided, together with methods for making and using them, that can be used on a wide variety of firearm models, can be used easily by either right-handed or left-handed shooters, and can be easily disassembled for replacement and/or repair of internal components.

In one example embodiment, a forend for a firearm includes an adapter module configured to mount below a barrel and in front of a receiver of a specific model of a firearm, such as a shotgun, a handgun or a rifle, and a universal accessory module coupled to one or more surfaces of the adapter module. The adapter module can include a substantially arcuate upper surface that substantially conforms to a portion of a lower surface of the barrel, a longitudinal bore configured to receive a tubular magazine of the firearm concentrically therein, lower and external side surfaces defining a plug, and an external surface defining a hand grip.

The accessory module can include a firearm accessory, such as a source of a light useful for illuminating or aiming the firearm at a target, one or more switches located on lateral side surfaces of the accessory module for selectably operating the accessory, and an upper and internal side surfaces that define a socket configured to receive the plug of the adapter module in a complementary plug-in engagement.

In another example embodiment, a method comprises providing an adapter module configured to mount below a barrel of a firearm and in front of a receiver thereof, and coupling an accessory module to one or more surfaces of the adapter module, wherein the accessory module comprises an external surface defining a hand grip.

In some embodiments, the one or more switches can be disposed in corresponding pairs on opposite lateral sides of the accessory module such that the accessory module can be selectably operated using either the right or the left hand of a shooter.

In some other embodiments, the universal accessory module can be decoupled from the adapter module and coupled to another adapter module that is specifically configured for and installed on another model of firearm.

The scope of the present invention is defined by the claims appended hereafter, which are incorporated into this section by reference. A more complete understanding of the features and advantages of the novel firearm forends of the invention and the methods for making and using them will be afforded to those skilled in the art by a consideration of the detailed description of some example embodiments thereof presented below, particularly if such consideration is made in conjunction with the appended drawings, wherein like reference numerals are used to identify like elements illustrated in one or more of the figures thereof.

BRIEF DESCRIPTION OF THE SEVERAL VIEWS OF THE DRAWINGS

FIG. 9B is a top plan view of the example adapter module of FIG. 9A;

FIG. 9C is a front end elevation view thereof;

FIG. 9D is a left side elevation view thereof;

FIG. 9E is a rear end elevation view thereof;

FIG. 9F is a cross-sectional view of the adapter module as seen along the lines of the section 9F-9F taken in FIG. 9D;

Embodiments of the invention and their advantages are best understood by referring to the detailed description that follows. It should be appreciated that like reference numerals are used to identify like elements illustrated in one or more of the figures.

DETAILED DESCRIPTION

In accordance with embodiments of the present disclosure, modular, accessory-mounting forends for firearms are provided, together with methods for making and using them, that can be used interchangeably on various models of firearms, that can be used by either right-handed or left-handed shooters, and that are easily disassembled for replacement and/or repair of internal components.

Figure 1:
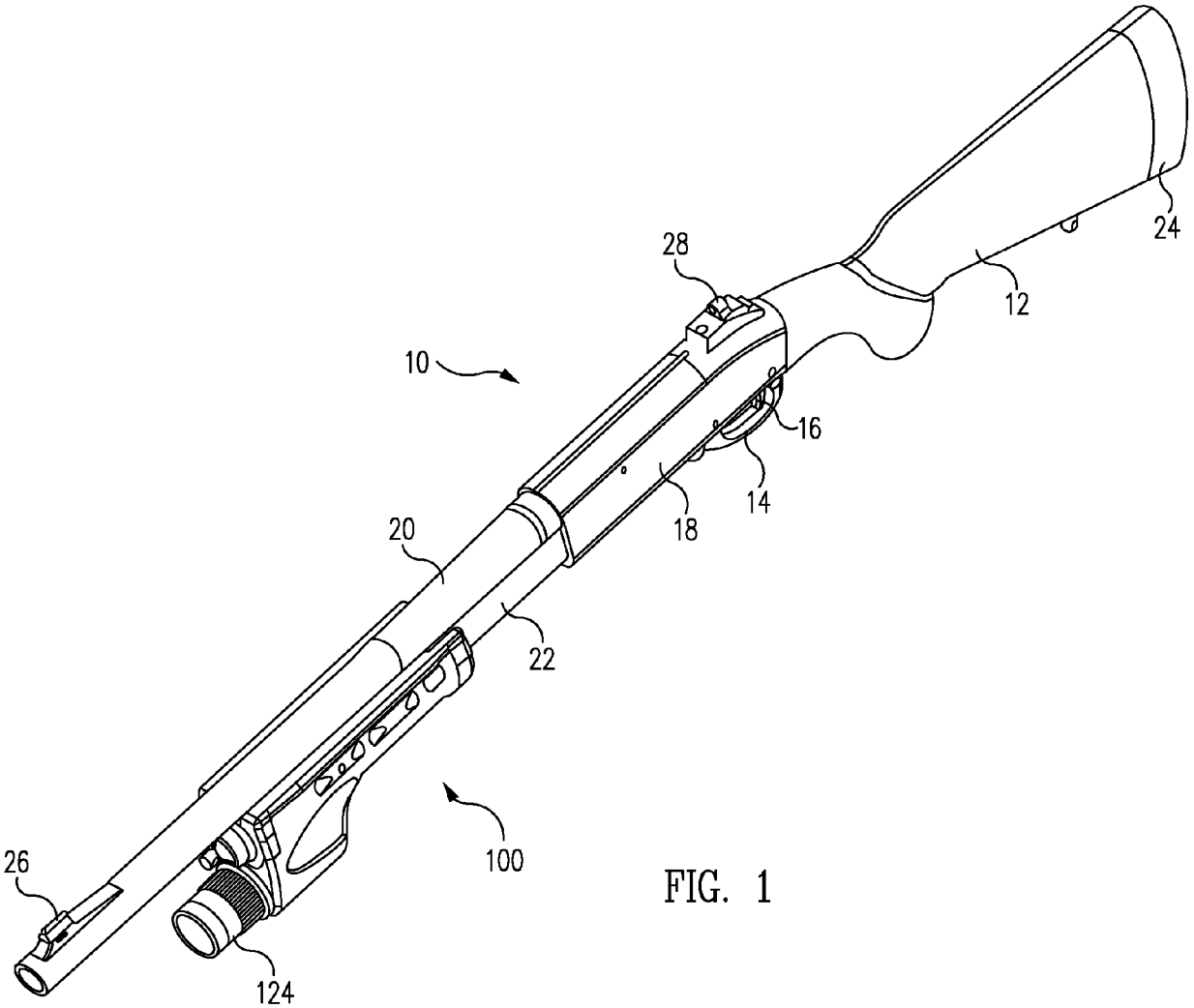
FIG. 1 is a upper, front, left-side perspective view of a firearm incorporating an example embodiment of an accessory-mounting firearm forend.
Figure 2:
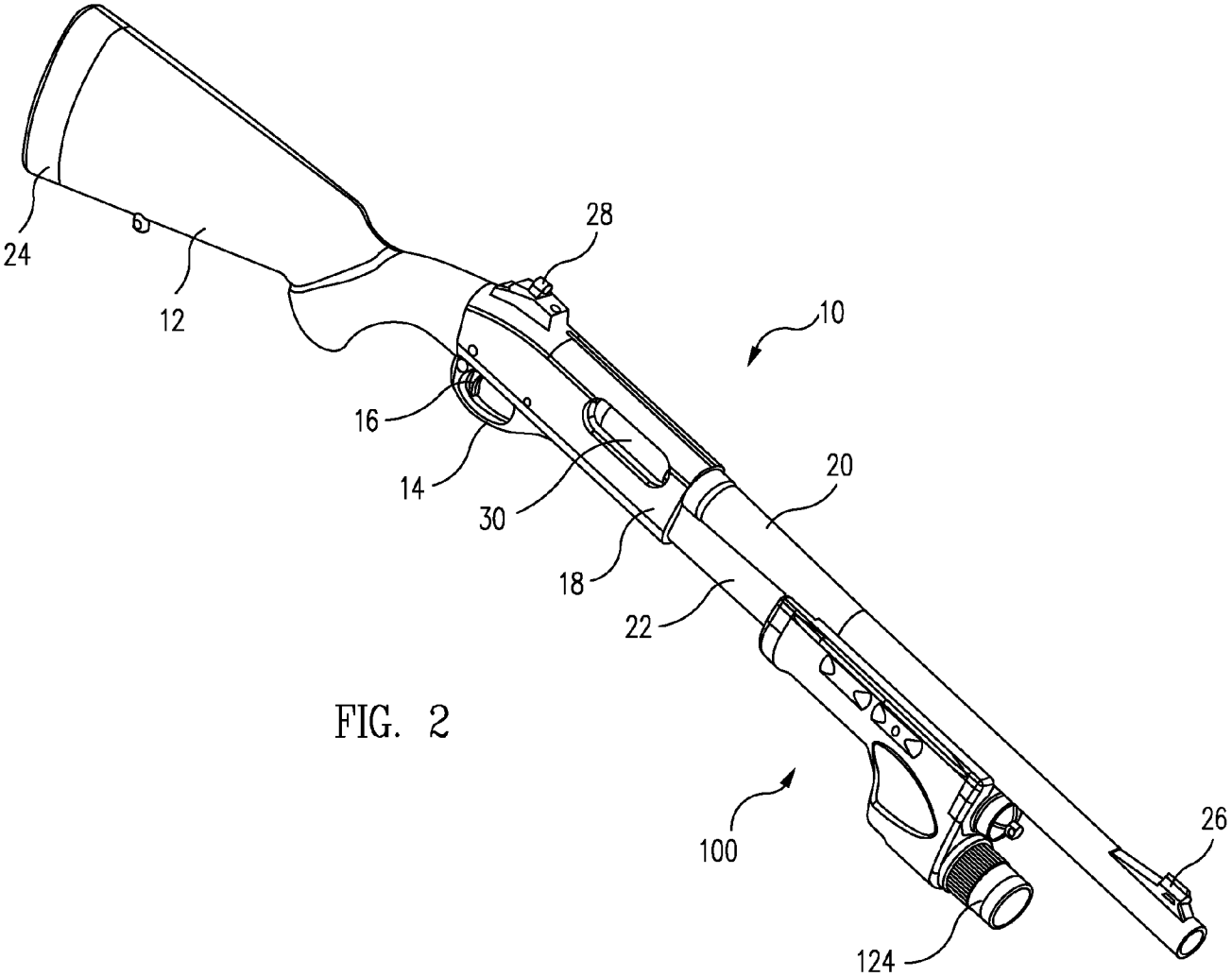
FIG. 2 is an upper, front, right-side perspective view of the firearm and example forend of FIG. 1.
Figure 3A:
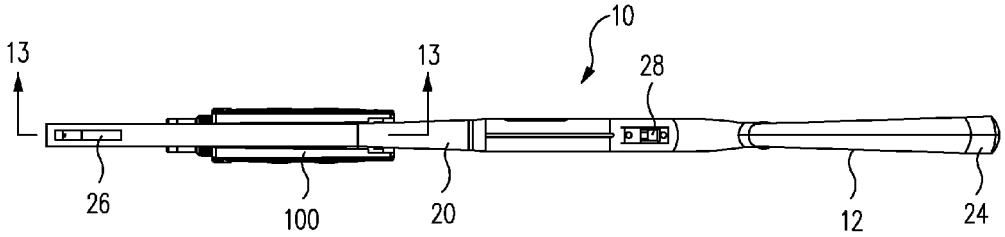
FIGS. 3A-3D are top plan, left side elevation, bottom plan, and right side elevation views of the firearm and example forend, respectively.
Figure 3B:
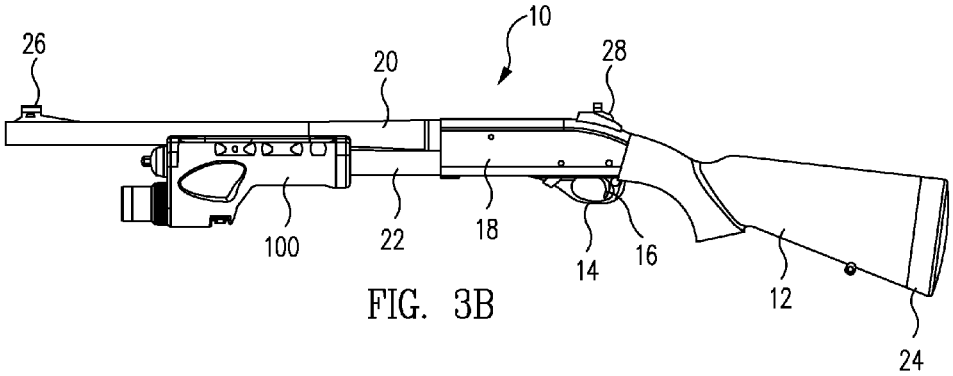
Figure 3C:
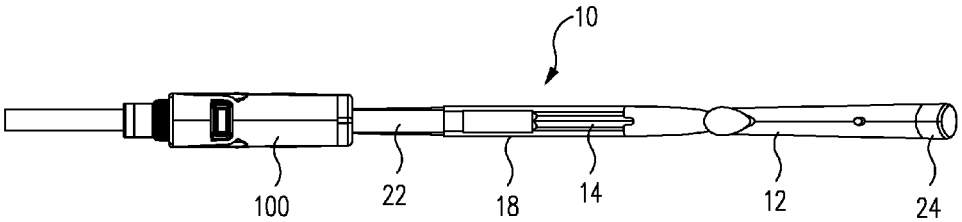
Figure 3D:
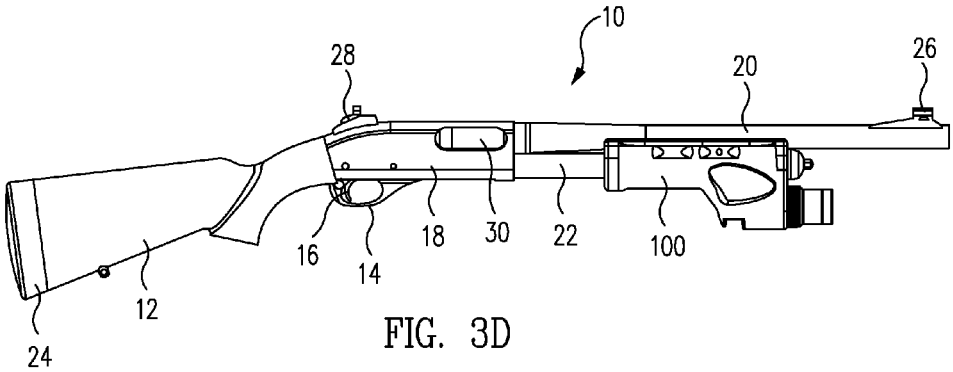

FIG. 1 is a upper, front, left side perspective view of an example firearm 10 incorporating an example embodiment of an accessory-mounting firearm forend 100 in accordance with the present disclosure, and FIG. 2 is an upper, front, right hand perspective view thereof. FIGS. 3A-3D are top plan, left side elevation, bottom plan, and right side elevation views of the firearm 10 and example forend 100, respectively In the particular embodiment of FIGS. 1, 2 and 3A-3D, the firearm 10 comprises a shotgun, viz., a pump-action shotgun, but it should be understood that the embodiments of forends 100 described herein are also suitable for advantageous use with other types of firearms, e.g., single shot, pump action, semiautomatic and fully automatic rifles, shotguns, pistols or handguns, machine guns, machine pistols, and the like.

As illustrated in FIGS. 1 and 2, the example firearm 10 comprises a shoulder stock 12, a trigger guard 14 guarding a trigger 16, a receiver 18, and an elongated, generally cylindrical barrel 20 and tubular magazine 22 protruding forwardly from a front end of the receiver 18. As illustrated, in some embodiments, a recoil pad 24 can be disposed at a rear end of the shoulder stock 12, and in other embodiments, the firearm 10 can include a fixed front sight 26 and an adjustable rear sight 28, e.g., a dispart or peep sight, useful for aiming the firearm 10. As illustrated in FIG. 2, the receiver 18 can include an ejection port 30 on one side through which spent shell casings are ejected from the firearm 10.

Figure 4A:
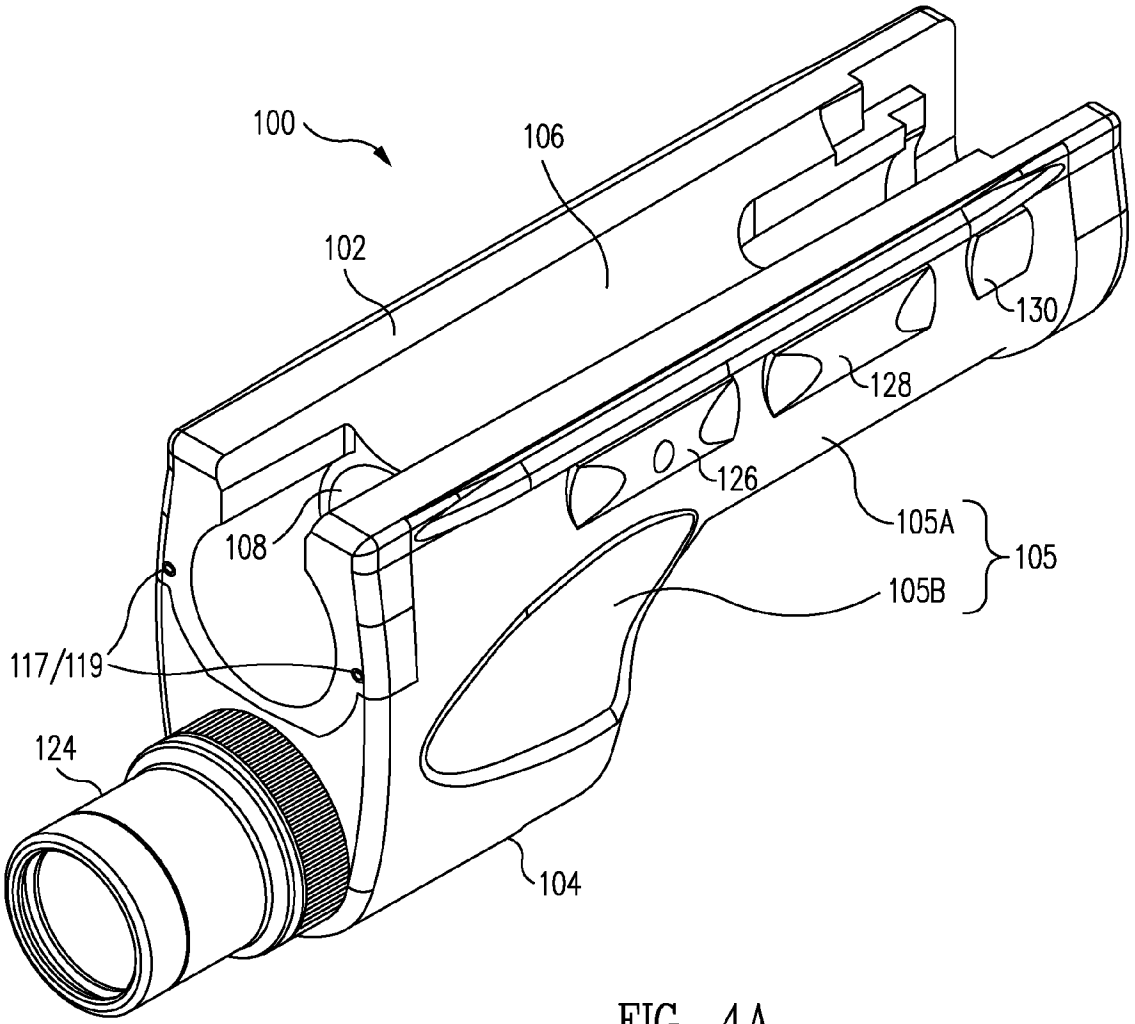
FIG. 4A is an upper, front, left side perspective view of the example forend.
Figure 4B:
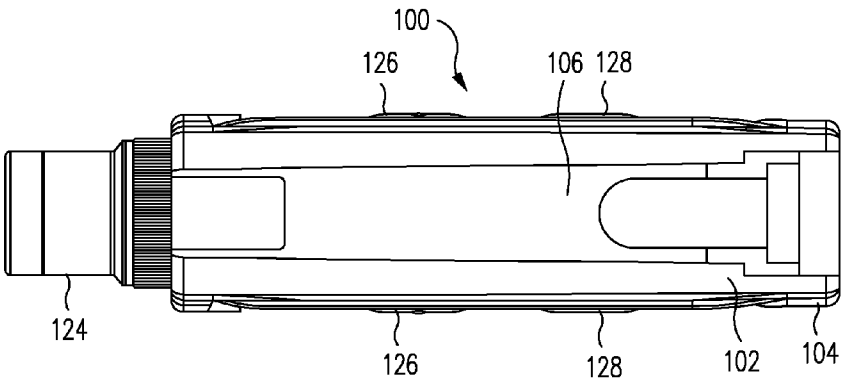
FIG. 4B is a top plan view thereof.

FIG. 4A is an upper, front, left side perspective view of the example forend 100, and FIGS. 4B-4G are a top plan, right side elevation, rear end elevation, right side elevation, front end elevation, and bottom plan views thereof, respectively. FIG. 5 is an upper, front, left side, exploded perspective view of the example forend 100.

As illustrated in these figures, the example forend 100 comprises a firearm adapter module 102 that is configured to mount below the barrel and in front of the receiver of a specific model of a firearm (e.g., the pump-action shotgun 10 in the embodiments illustrated in FIGS. 1-3D and 13), and a "universal" firearm accessory module 104 that is configured to couple to one or more surfaces (e.g., one or more lower surfaces, side surfaces, and/or other surfaces) of the firearm adapter module 102 and comprising one or more external surfaces defining a hand grip 105. For example, in some embodiments, hand grip 105 may include a surface 105A configured to be grasped by a palm, fingers, and/or thumb of a user's hand, and may also include one or more of surfaces 105B configured to be grasped by fingers and/or a thumb of a user's hand. Such configurations may permit the user to conveniently hold firearm 10 and/or pull hand grip 105 back toward the user (e.g., to operate a pump-action weapon). In this regard, surfaces 105A and/or 105B may be smooth and/or recessed to accommodate convenient operation by the user.

Figure 13:
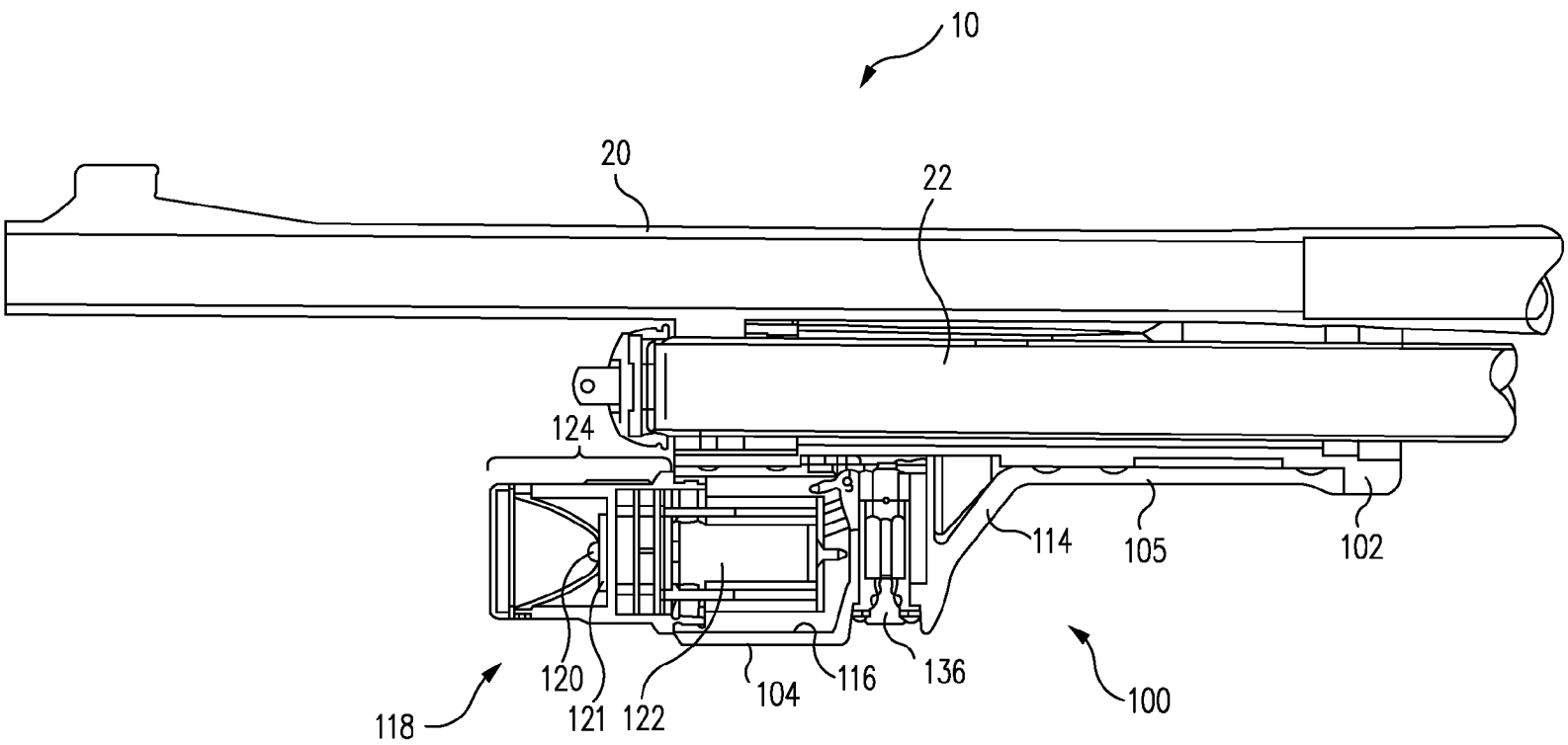
FIG. 13 is a cross-sectional view of a front end of the firearm barrel and the example forend, as seen along the lines of the section 13-13 taken in FIG. 3A.

As illustrated in, e.g., FIGS. 4A-4G, in one example embodiment, the firearm adapter module 102 can comprise a substantially arcuate upper surface 106 that substantially conforms to a portion of a lower surface of the barrel 20 of the firearm 10, and a longitudinal bore 108 configured to receive the tubular magazine 22 of the firearm 10 disposed concentrically therein (see FIG. 13). In some embodiments, the upper surface 106 may contact the lower surface of the barrel 20. In some embodiments, the upper surface 106 may be proximate to the lower surface of the barrel 20 but not in contact therewith.

As illustrated in, e.g., FIGS. 5, 6A-6H, 7A-7F, 8A-8F, and 9A-9F, in some advantageous embodiments, the lower and external side surfaces of the adapter module 102 can define a universal "plug" 110 (e.g., providing one or more mating surfaces), and as illustrated in FIG. 5 and FIGS. 10A-10I, the upper and internal side surfaces of a housing 114 of the accessory module 104 can define a universal "socket" 112 (e.g., providing one or more mating surfaces) that is configured to receive the plug 110 in a complementary plug-in engagement.

Figure 6A:
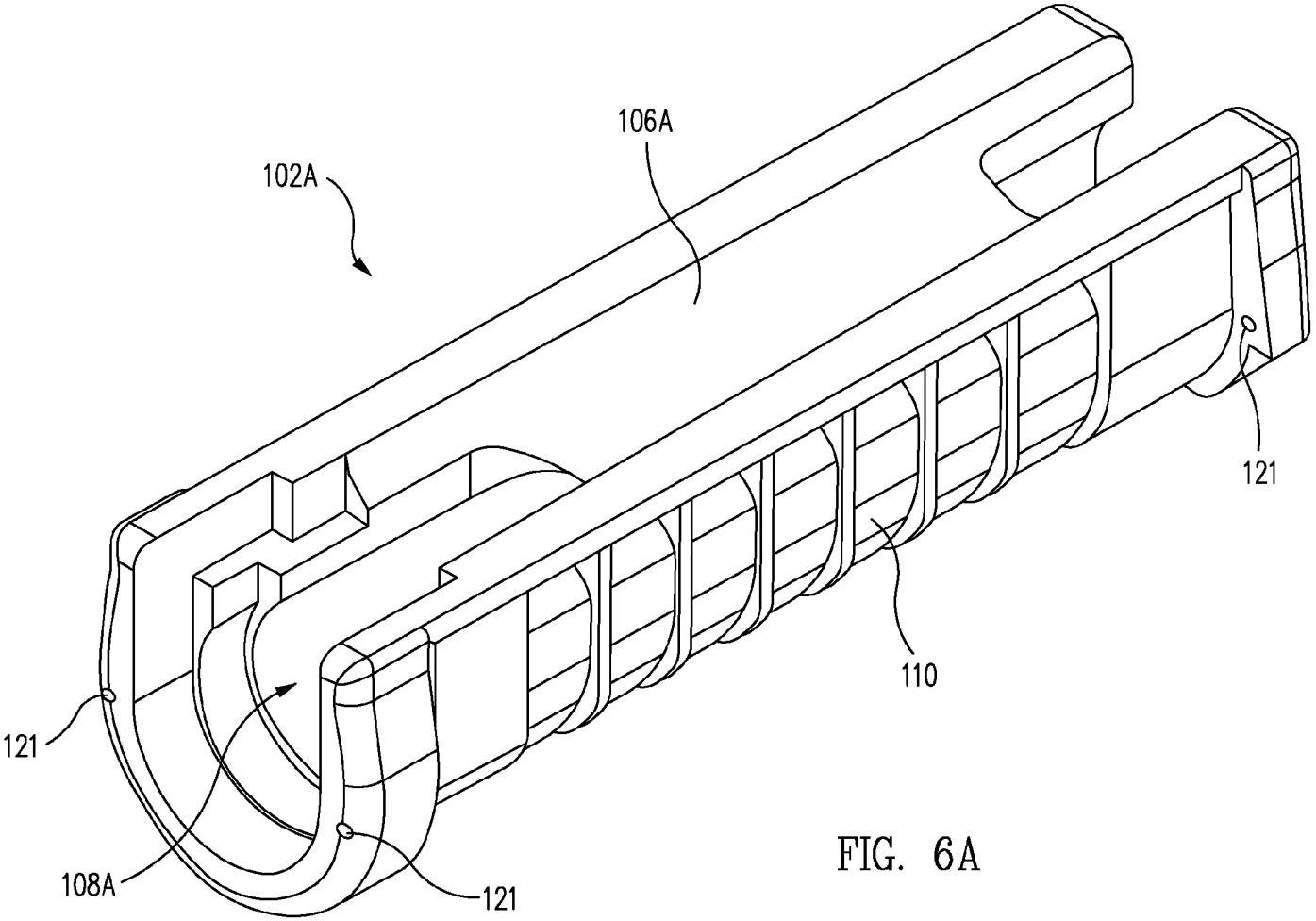
FIG. 6A is an upper, rear, right-side perspective view of an example embodiment of a firearm adapter module of the forend.
Figure 6B:
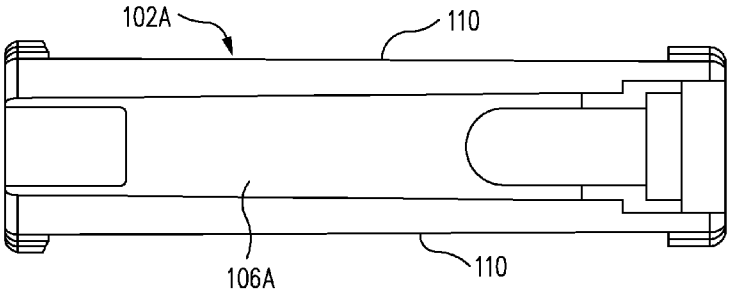
FIG. 6B is a top plan view of the example adapter module of FIG. 6A.
Figure 6C:
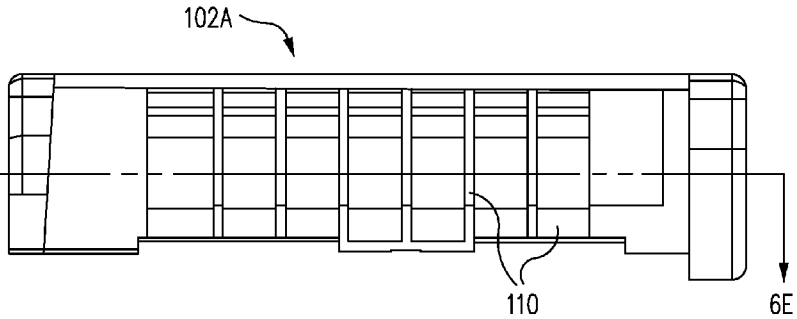
FIG. 6C is a left side elevation view thereof.
Figure 6D:
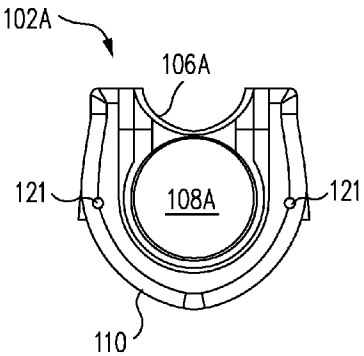
FIG. 6D is a rear end elevation view thereof.
Figure 6E:
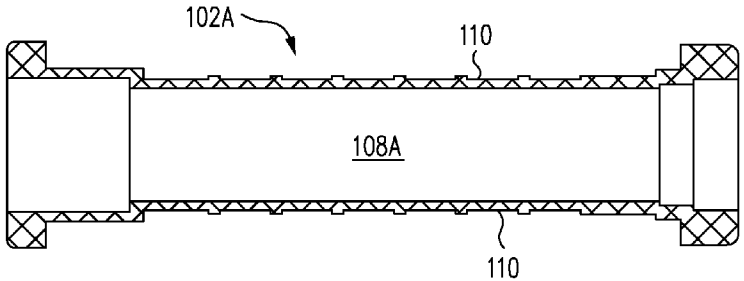
FIG. 6E is a cross-sectional view of the adapter module as seen along the lines of the section 6E-6E taken in FIG. 6C.
Figure 6G:
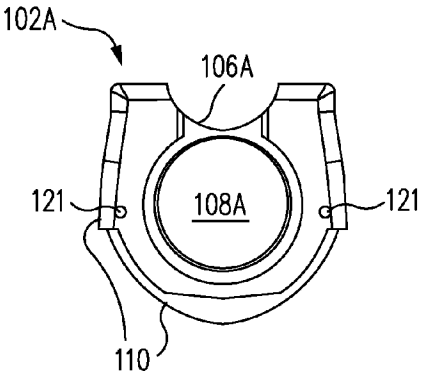
FIG. 6G is a front end elevation view thereof.
Figure 6F:
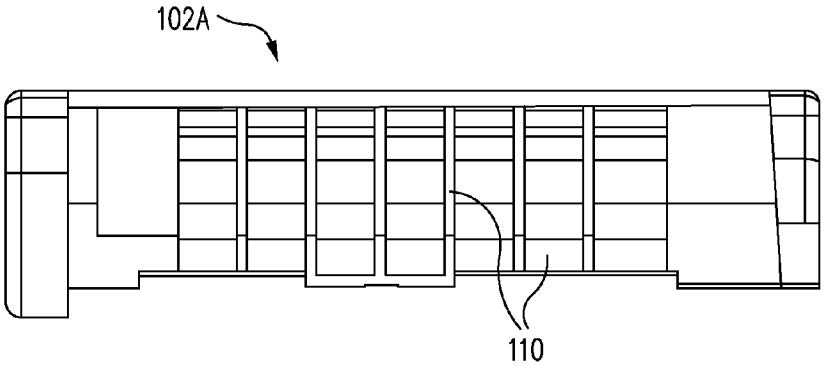
FIG. 6F is a right side elevation view thereof.
Figure 6H:
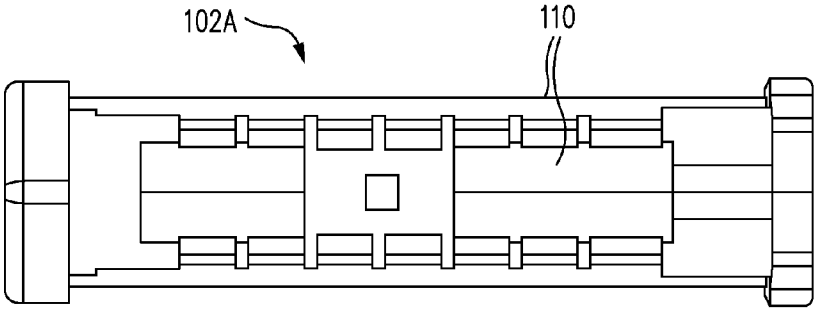
FIG. 6H is a bottom plan view thereof.

By way of some examples thereof, FIG. 6A is an upper, front, rear, right side perspective view of an example embodiment of a firearm adapter module 102A that is specifically configured to mount to a Remington Model 580 shotgun, and FIGS. 6B-6D are top plan, left side elevation, and rear end elevation views thereof, respectively. FIG. 6E is a cross-sectional view of the adapter module 102A as seen along the lines of the section 6E-6E taken in FIG. 6C, and FIGS. 6F-6H are right side elevation, front end elevation, and bottom plan views thereof respectively.

Figure 7A:
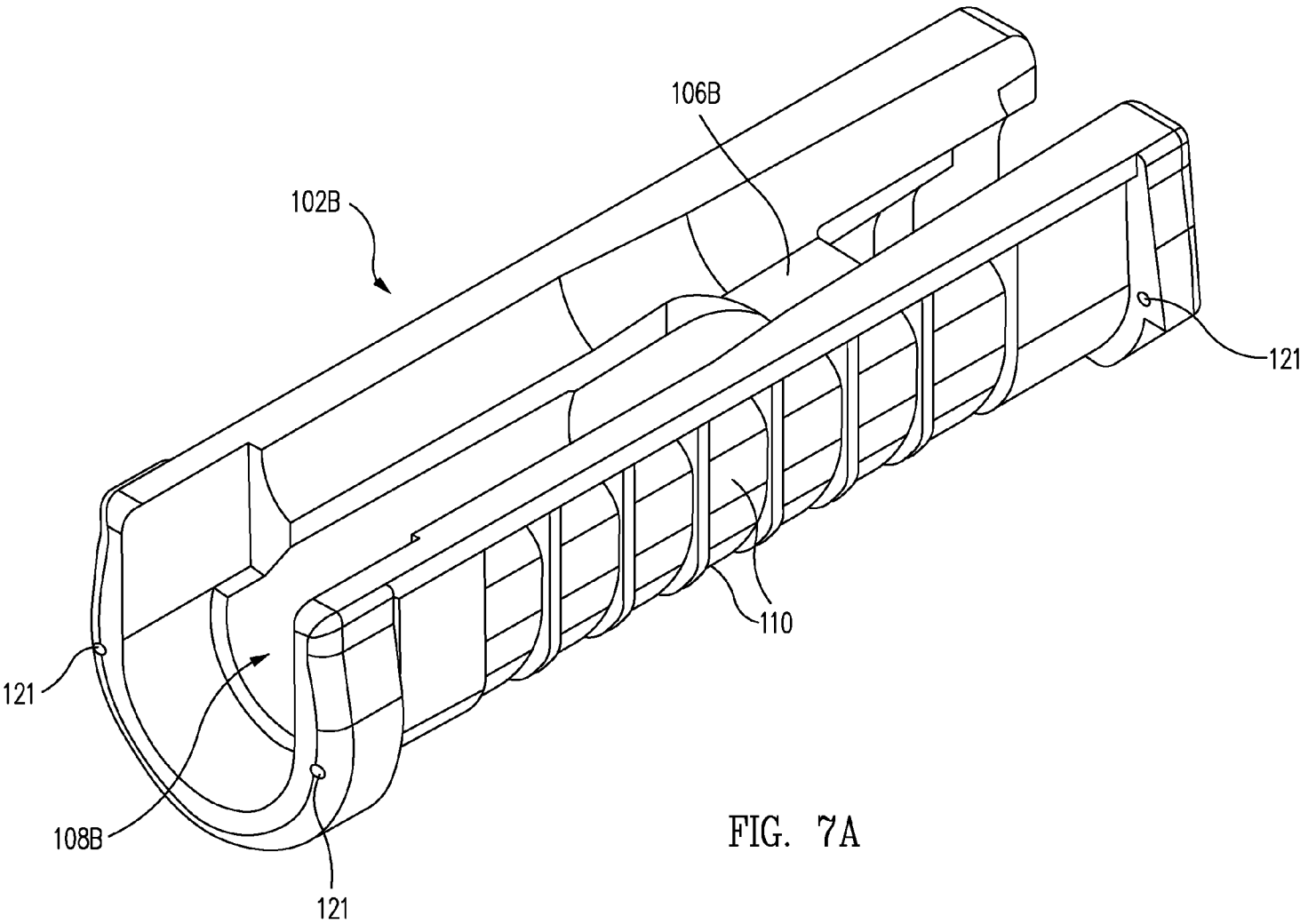
FIG. 7A is an upper, rear, right-side perspective view of another example embodiment of a firearm adapter module of the forend.
Figure 7B:
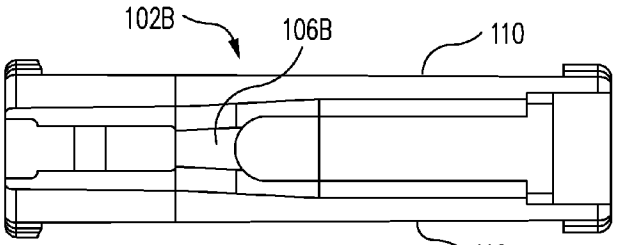
FIG. 7B is a top plan view of the example adapter module of FIG. 7A.
Figure 7E:
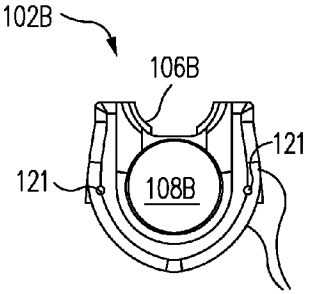
FIG. 7E is a rear end elevation view thereof.
Figure 7D:
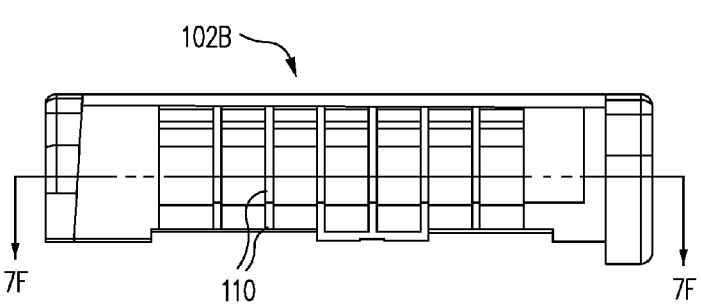
FIG. 7D is a left side elevation view thereof.
Figure 7F:
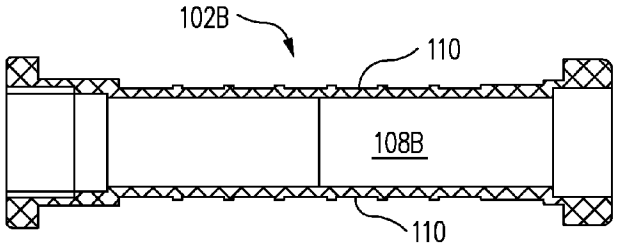
FIG. 7F is a cross-sectional view of the adapter module as seen along the lines of the section 7F-7F taken in FIG. 7D.
Figure 7C:
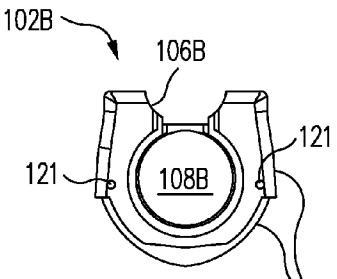
FIG. 7C is a front end elevation view thereof.

FIG. 7A is an upper, rear, right side perspective view of another example embodiment of a firearm adapter module 102B that is specifically configured to mount to a Mossberg Model 500 shotgun, and FIGS. 7B-7E are top plan, front end elevation, left side elevation, and rear end elevation views thereof, respectively. FIG. 7F is a cross-sectional view of the adapter module 102B as seen along the lines of the section 7F-7F taken in FIG. 7D.

Figure 8A:
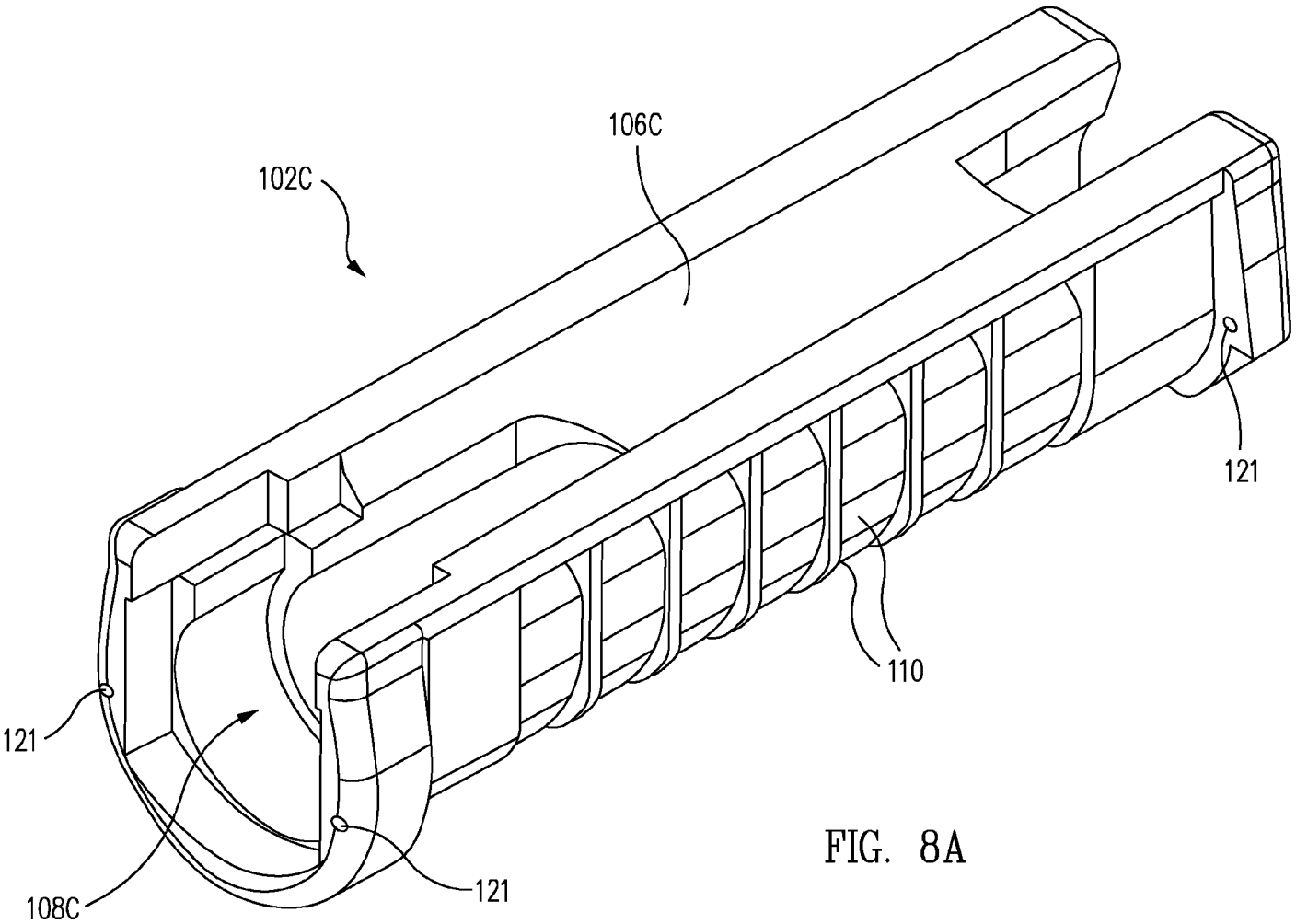
FIG. 8A is an upper, rear, right-side perspective view of yet another example embodiment of a firearm adapter module of the forend.
Figure 8B:
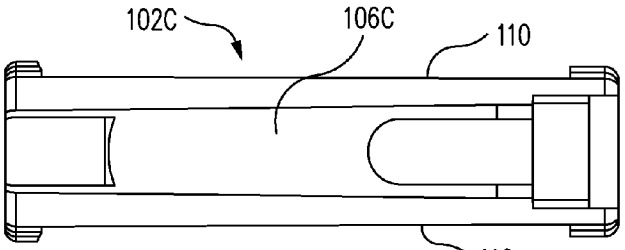
FIG. 8B is a top plan view of the example adapter module of FIG. 8A.
Figure 8E:
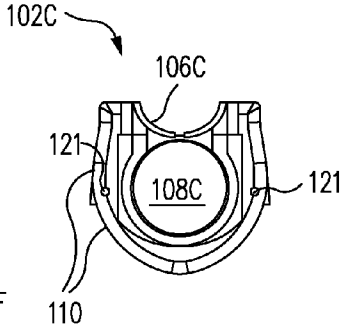
FIG. 8E is a rear end elevation view thereof.
Figure 8D:
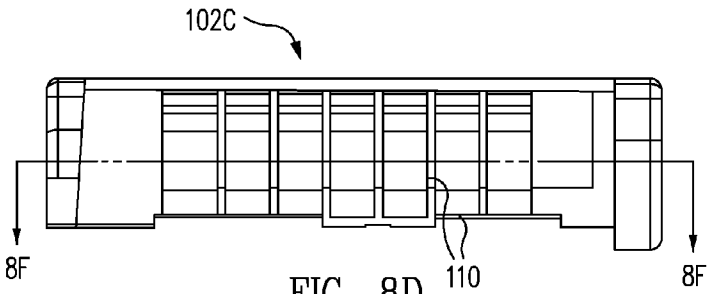
FIG. 8D is a left side elevation view thereof.
Figure 8F:
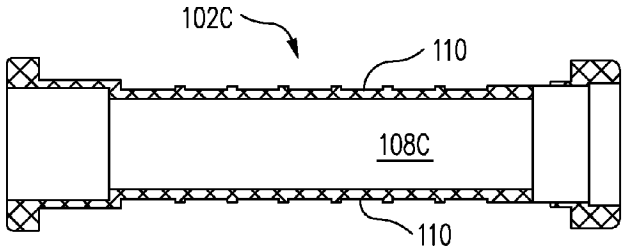
FIG. 8F is a cross-sectional view of the adapter module as seen along the lines of the section 8F-8F taken in FIG. 8D.
Figure 8C:
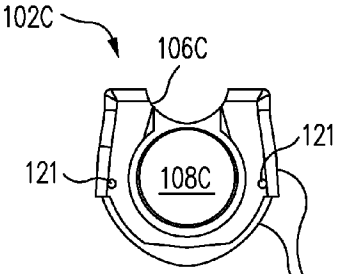
FIG. 8C is a front end elevation view thereof.

FIG. 8A is an upper, rear, right side perspective view of yet another example embodiment of a firearm adapter module 102C that is specifically configured to mount to a Winchester "Defender" Model shotgun, and FIGS. 8B-8E are top plan, front end elevation, left side elevation, and rear end elevation views thereof, respectively. FIG. 8F is a cross-sectional view of the firearm adapter module 102 as seen along the lines of the section 8F-8F taken in FIG. 8D.

Figure 9A:
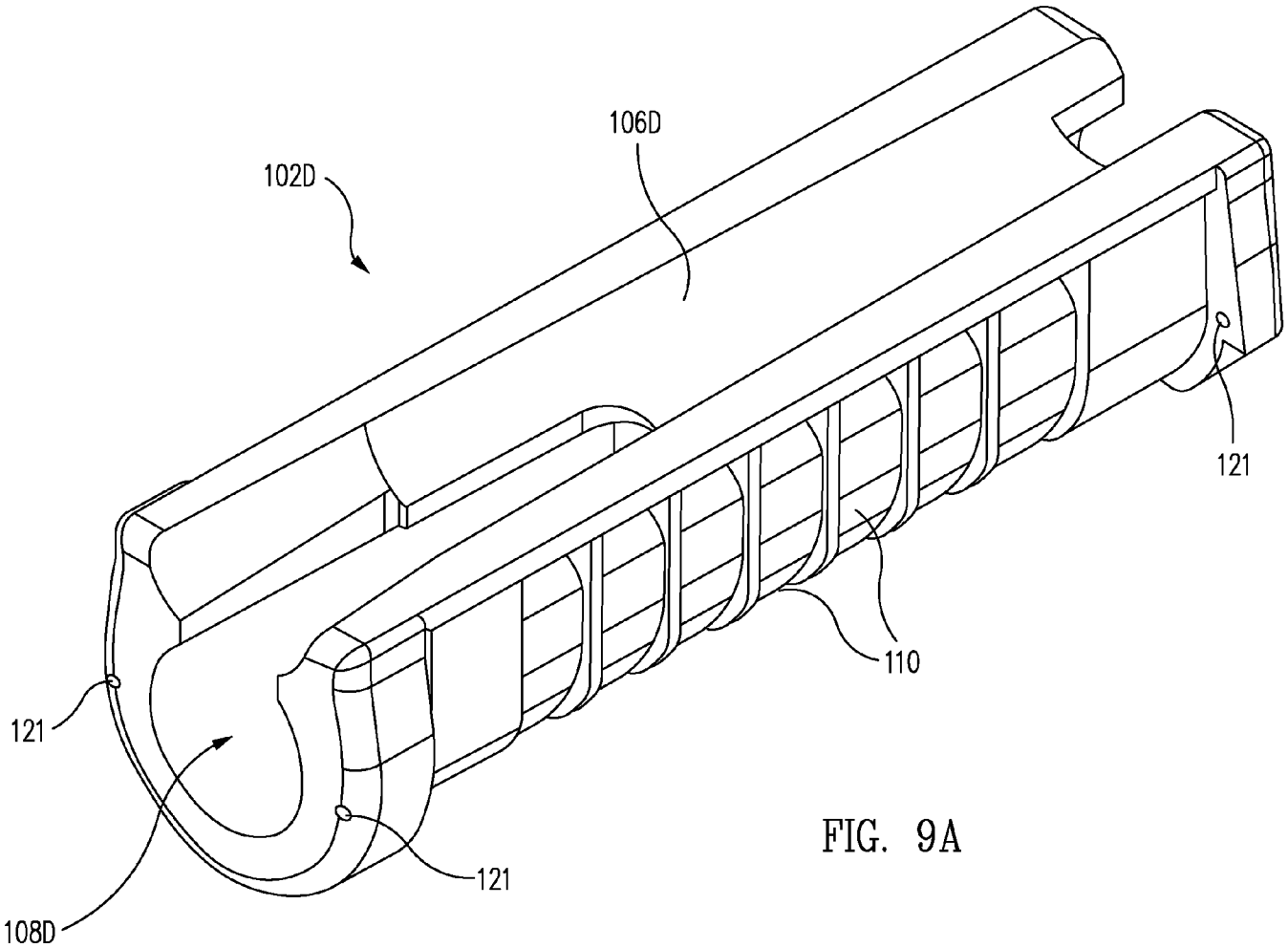
FIG. 9A is an upper, rear, right-side perspective view of still yet another example embodiment of a firearm adapter module of the forend.

FIG. 9A is an upper, rear, right side perspective view of still yet another example embodiment of a firearm adapter module 102D that is specifically configured to mount to Benelli M1 and M2 Model shotguns, and FIGS. 9B-9E are top plan, front end elevation, left side elevation, and rear end elevation views thereof, respectively. FIG. 9F is a cross-sectional view of the adapter module 102 as seen along the lines of the section 9F-9F taken in FIG. 9D.

As can be seen from these foregoing four example embodiments of firearm adapter modules 102A-D, each of the upper surfaces 106A-D and longitudinal bores 108A-D thereof are uniquely configured to mount to a specific model of firearm 10, whereas, their respective lower and external side surfaces 110 are substantially identical to each other so as to define a universal plug that is configured to be received in the complementary socket 112 defined by the housing 114 of the firearm accessory module 104. Although particular firearms are described herein, other firearms may be used.

In some embodiments, at least one of the adapter module 102 and the accessory module 104 can comprise a molded plastic, such as an injection molded thermoplastic. In some embodiments, the accessory module 104 can be permanently coupled to the adapter module 102, e.g., by an adhesive. In other embodiments, the accessory module 104 can be releasably coupled to the adapter module 102 by one or more fasteners such as, for example roll pins 117 (e.g., configured to be received by apertures 119 of housing 114 and apertures 121 of adapter module 102) or other arrangements.

As discussed above, one of the drawbacks of prior art forends is they are typically configured for and can be used only on a specific model of firearm. Thus, if a user wishes to obtain the same functionality provided by the forend on a second, different model of firearm, he or she must purchase another forend that is specifically configured for use on that model. However, since in some embodiments, the accessory module 104 can easily be decoupled from the adapter module 102 on the first firearm, and further, is configured to be coupled to any other adapter module 102 having a complementary plug 110 of the type discussed above, the user can overcome this drawback by obtaining a second adapter module 102 that is specifically configured for installation on the second firearm and then coupling the same accessory module 104 on the second adapter module 102. The accessory module 104 is thus interchangeable between the two different firearms, and indeed, other and different firearms that the user might acquire thereafter.

Figure 10A:
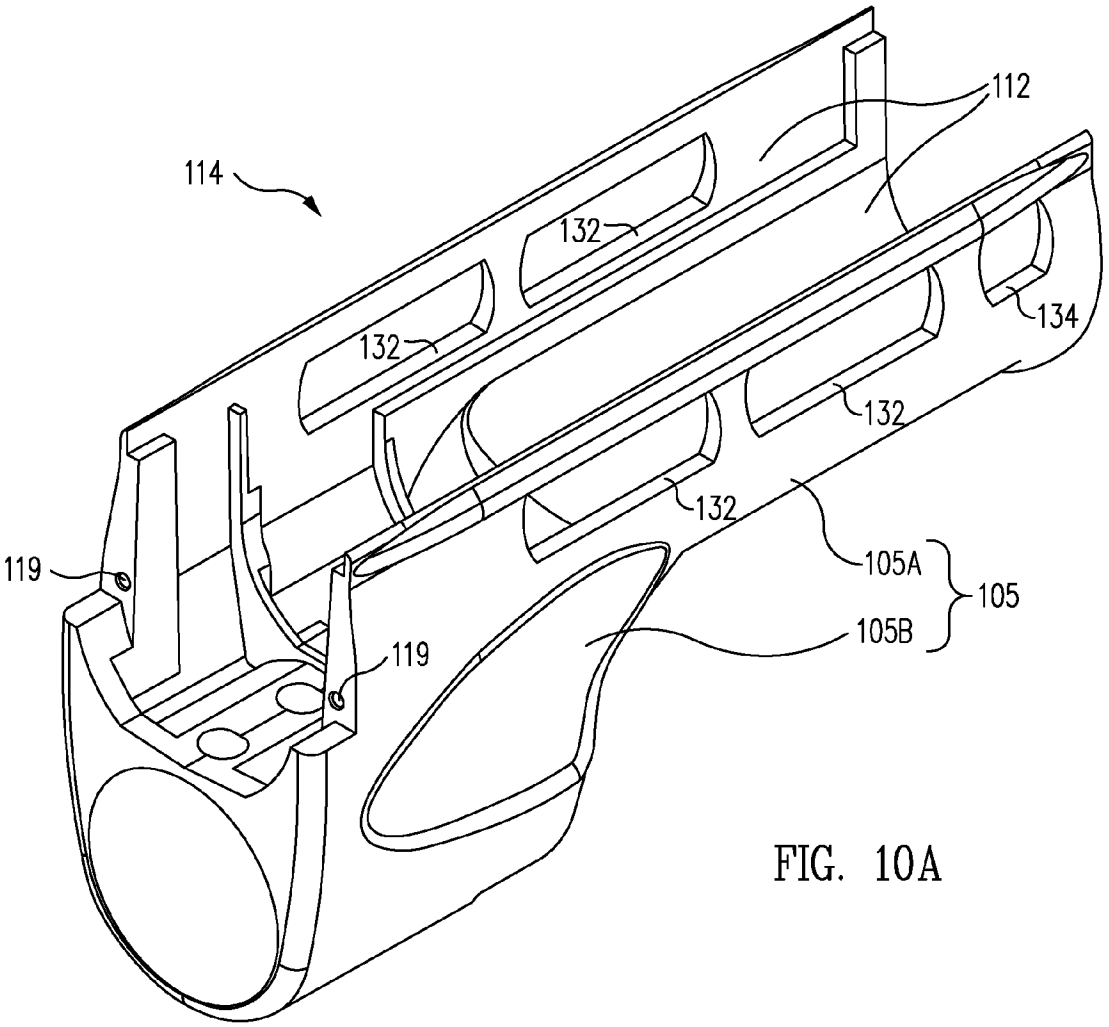
FIG. 10A is an upper, front, left-side perspective view of an example embodiment of an accessory module housing of the example forend.
Figure 10D:
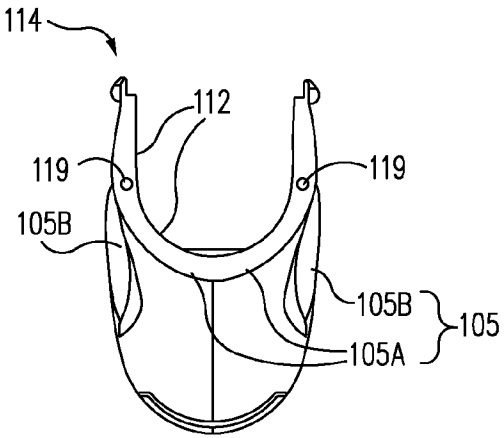
FIG. 10D is a rear end elevation view thereof.
Figure 10B:
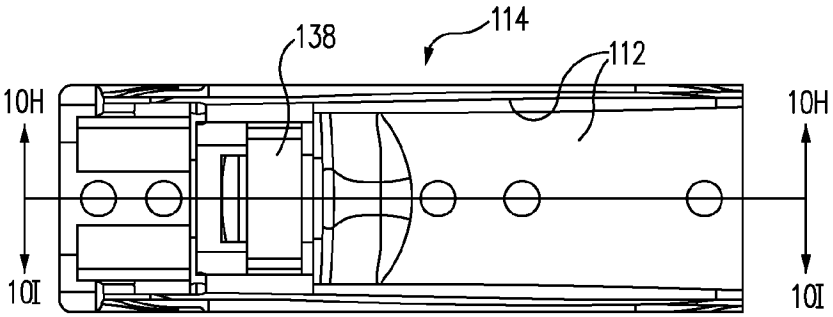
FIG. 10B is a top plan view thereof.
Figure 10C:
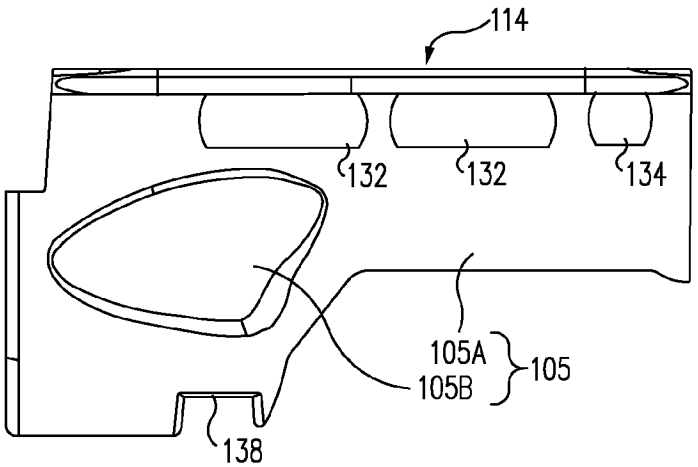
FIG. 10C is a left side elevation of thereof.
Figure 10F:
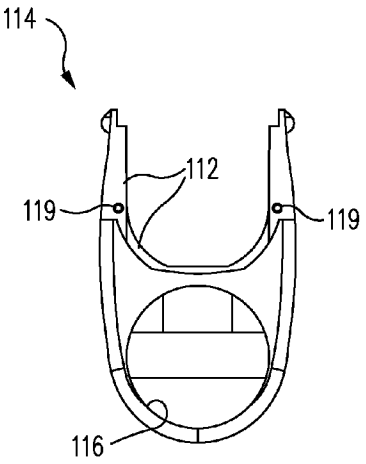
FIG. 10F is a front end elevation view thereof.
Figure 10E:
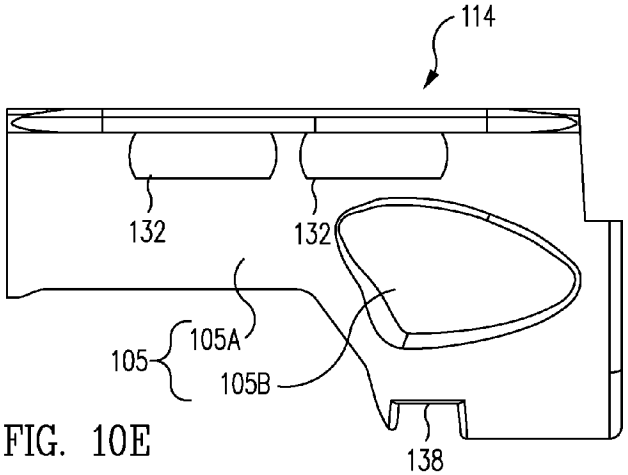
FIG. 10E is right side elevation view hereof.
Figure 10G:
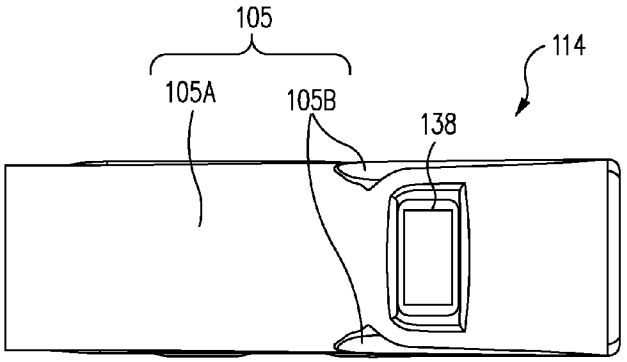
FIG. 10G is a bottom plan view thereof.
Figure 10H:
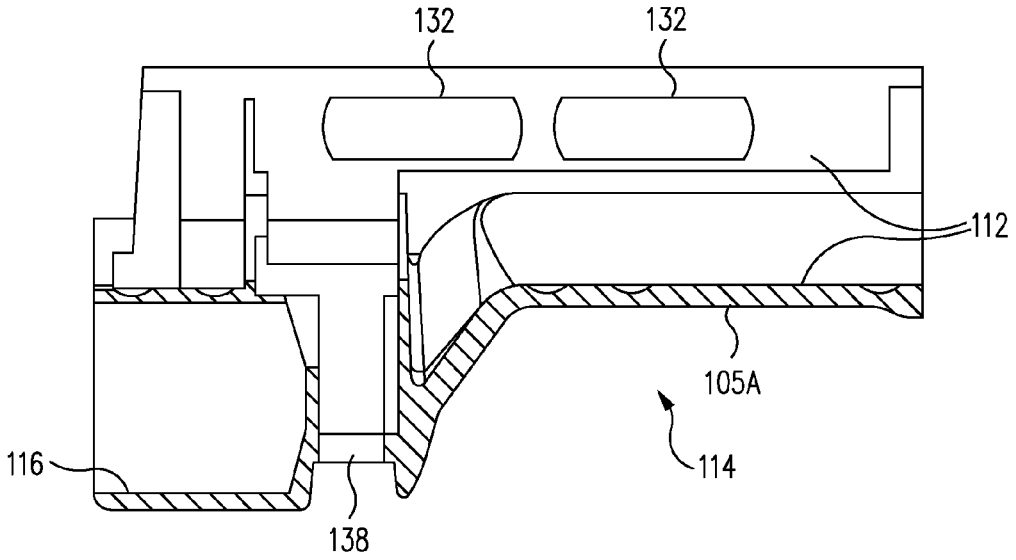
FIG. 10H is a cross-sectional view of the example accessory adapter module housing as seen along the lines of the section 10H-10H taken in FIG. 10B.
Figure 10I:
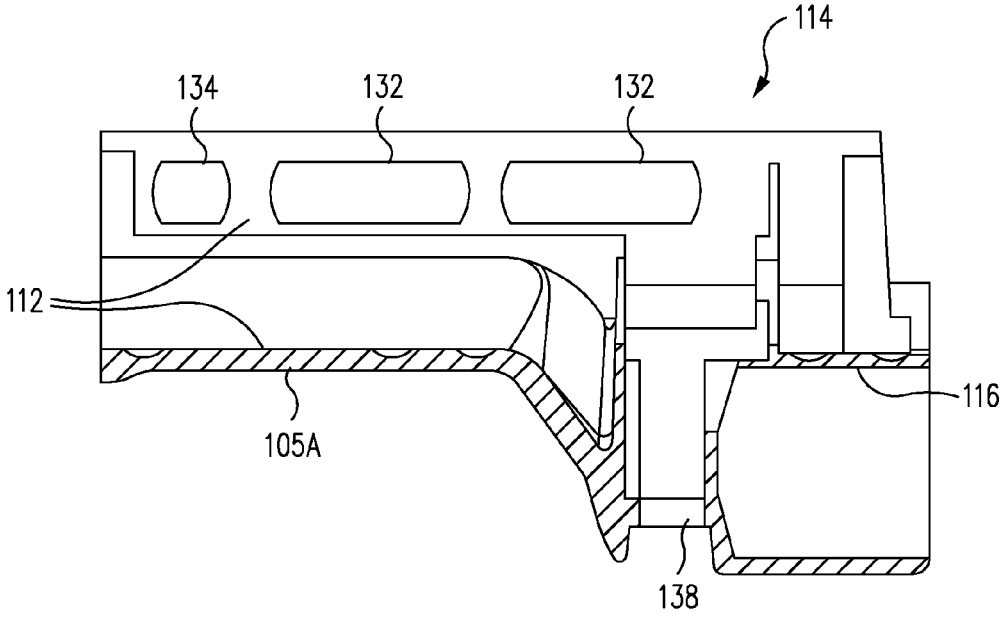
FIG. 10I is a cross-sectional view of the example accessory adapter module housing as seen along the lines of the section 10I-10I taken in FIG. 10B.
Figure 11A:
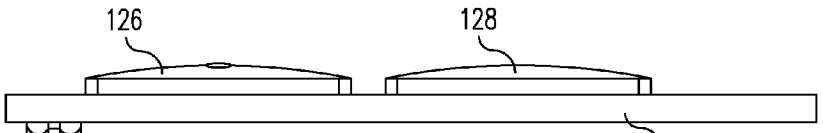
FIGS. 11A-11F are top plan, front end elevation, left side elevation, rear end elevation, bottom plan, and right side elevation views, respectively, of an example embodiment of a plate incorporating a plurality of switches of the example forend.
Figure 11C:
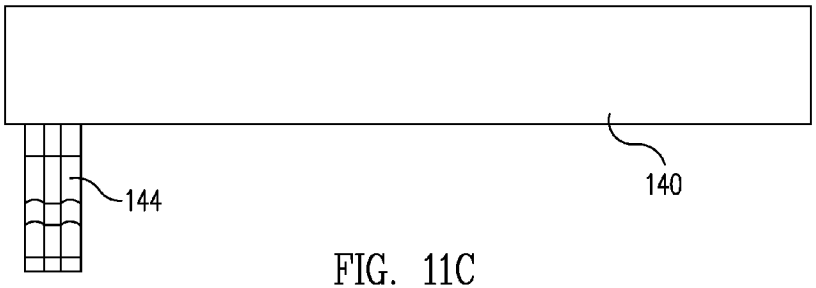
Figure 11D:
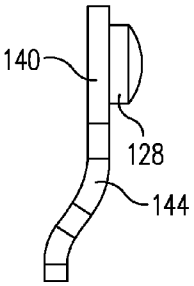
Figure 11B:
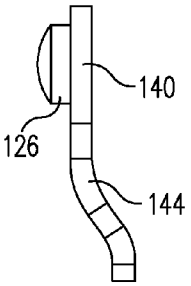
Figure 11E:
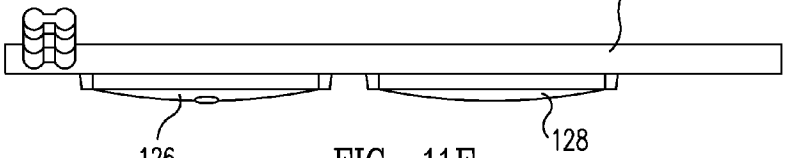
Figure 11F:
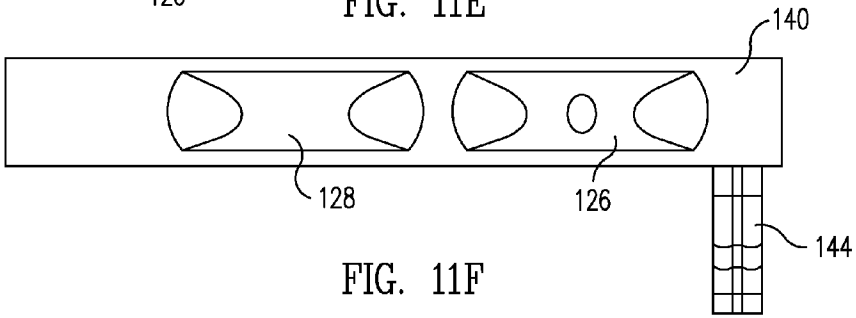
Figure 12A:
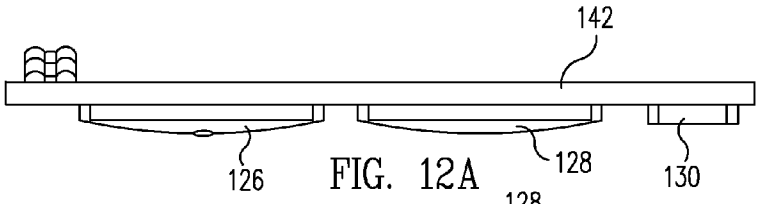
FIGS. 12A-12F are top plan, front end elevation, left side elevation, rear end elevation, bottom plan, and right side elevation views, respectively, of another example embodiment of a plate incorporating a plurality of switches of the example forend.
Figure 12C:
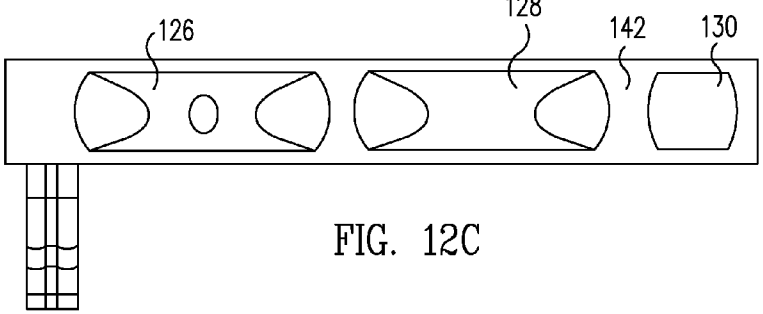
Figure 12D:
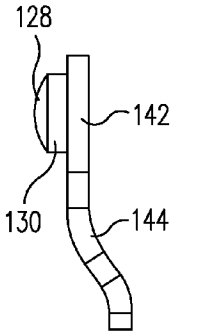
Figure 12E:
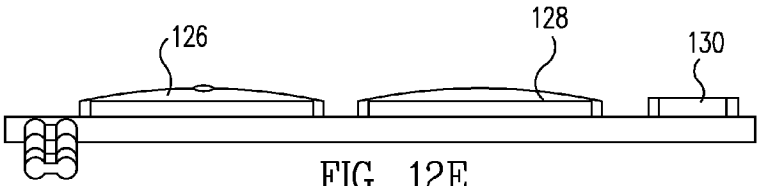
Figure 12F:
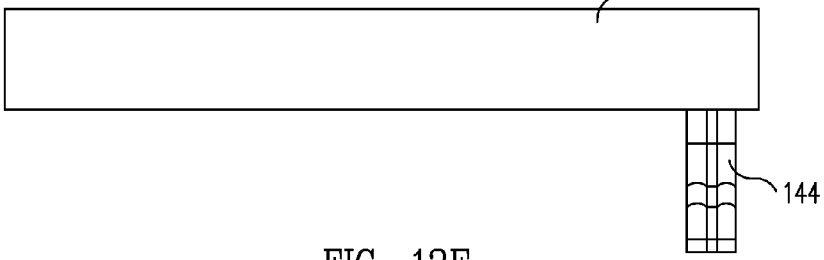
Figure 12B:
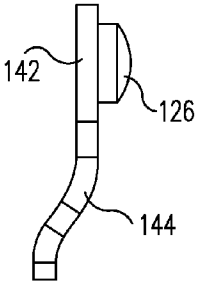

FIG. 10A is an upper, front, left side perspective view of the housing 114 of the example accessory module 104, and FIGS. 10B-10G are top plan, left side elevation, rear end elevation, right side elevation, front end elevation, and bottom plan views thereof, respectively. FIG. 10H is a cross-sectional view of the example housing 114 as seen along the lines of the section 10H-10H taken in FIG. 10B, and FIG. 10I is a cross-sectional view of the example accessory adapter module housing 114 as seen along the lines of the section 10I-10I taken in FIG. 10B.

As can be seen in these figures, in addition to the external surface defining a hand grip 105 and the upper and internal side surfaces defining a universal socket 112 that is configured to receive the plug 110 of the adapter module 102, the housing 114 of the firearm accessory module 104 can also include, for example, a forward-facing, generally cylindrical bore 116 that is configured to receive one or more firearm accessories. As illustrated in FIGS. 5 and 13, the firearm accessory can comprise a lighting device 118, including a light source 120, such as a light emitting diode (LED), that is provided on a circuit board 123 powered by, for example, one or more batteries 122. In some embodiments, the lighting device 118 can be disposed substantially entirely within the bore 116 of the accessory module housing 114. In some embodiments, some or all of lighting device 118 may protrude forwardly therefrom, such as a head 124 of lighting device 118 as shown in FIGS. 4A-G and 13. For example, head 124 may be used to focus a beam of light produced by the light source 120 when selectively actuated.

In some embodiments, the lighting device 118 may be controlled by the user of the firearm 10. In some embodiments, such control may be implemented by first and second pairs of corresponding user operable switches 126 and 128 respectively disposed on opposite lateral sides of the accessory module 104, each disposed in substantially bilaterally symmetrical alignment with each other in relation to a longitudinal axis of the accessory module 104 (e.g., mirror images of each other in some embodiments), each switch 126 and 128 being configured to adjust one or more operations of the light source 120 in response to a user manipulation thereof. For example, in some embodiments, switches 126 may be used to selectively turn light source 120 on and off in a momentary fashion (e.g., turn on light source 120 while pressed, and turn off light source 120 when released). In some embodiments, switches 128 may be used to selectively turn light source 120 on and off in a constant fashion (e.g., turn on light source 120 when pressed a first time, and turn off light source 120 when pressed a second time).

Figure 4C:
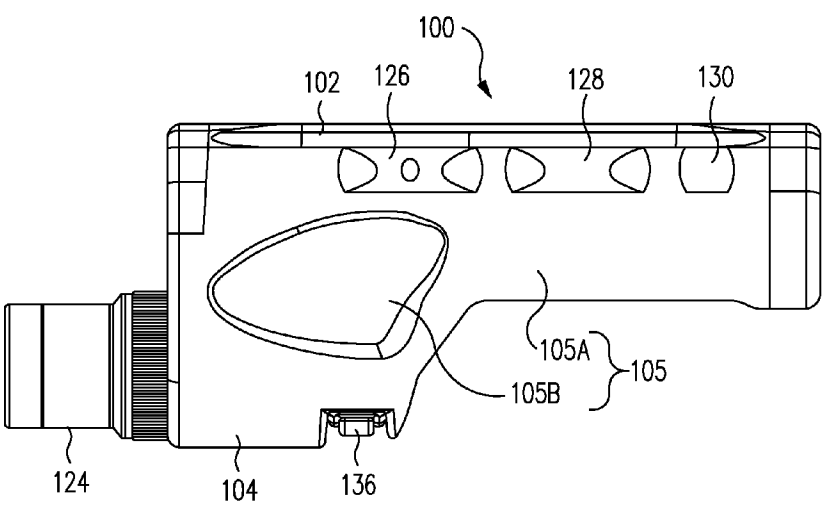
FIG. 4C is a left side elevation view thereof.
Figure 4D:
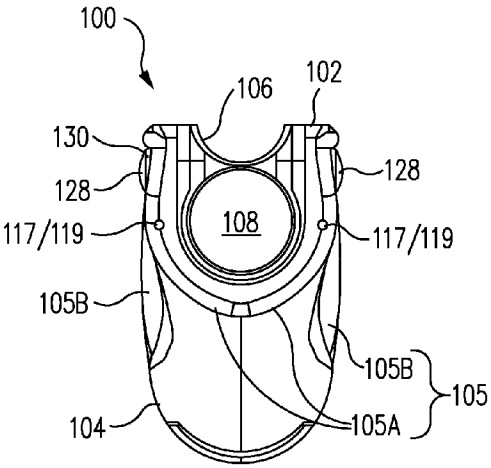
FIG. 4D is a rear end elevation view thereof.
Figure 4F:
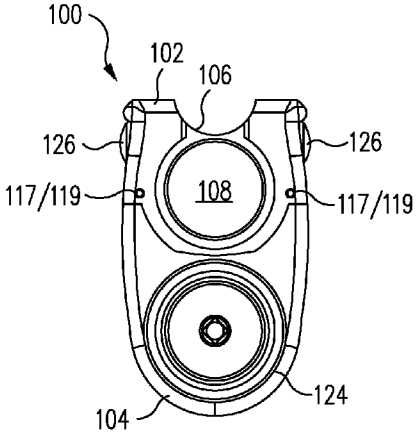
FIG. 4F is a front end elevation view thereof.
Figure 4E:
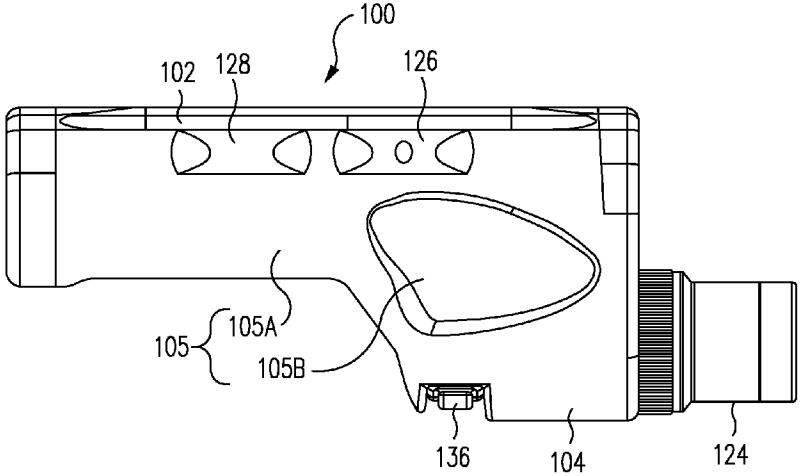
FIG. 4E a right side elevation view thereof.
Figure 4G:
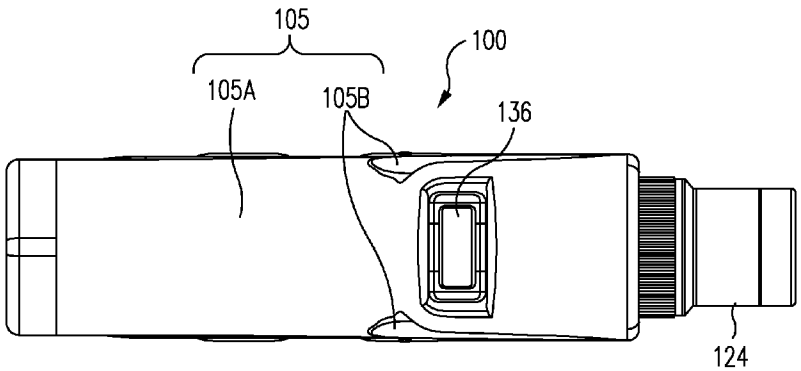
FIG. 4G is a bottom plan view thereof.
Figure 5:
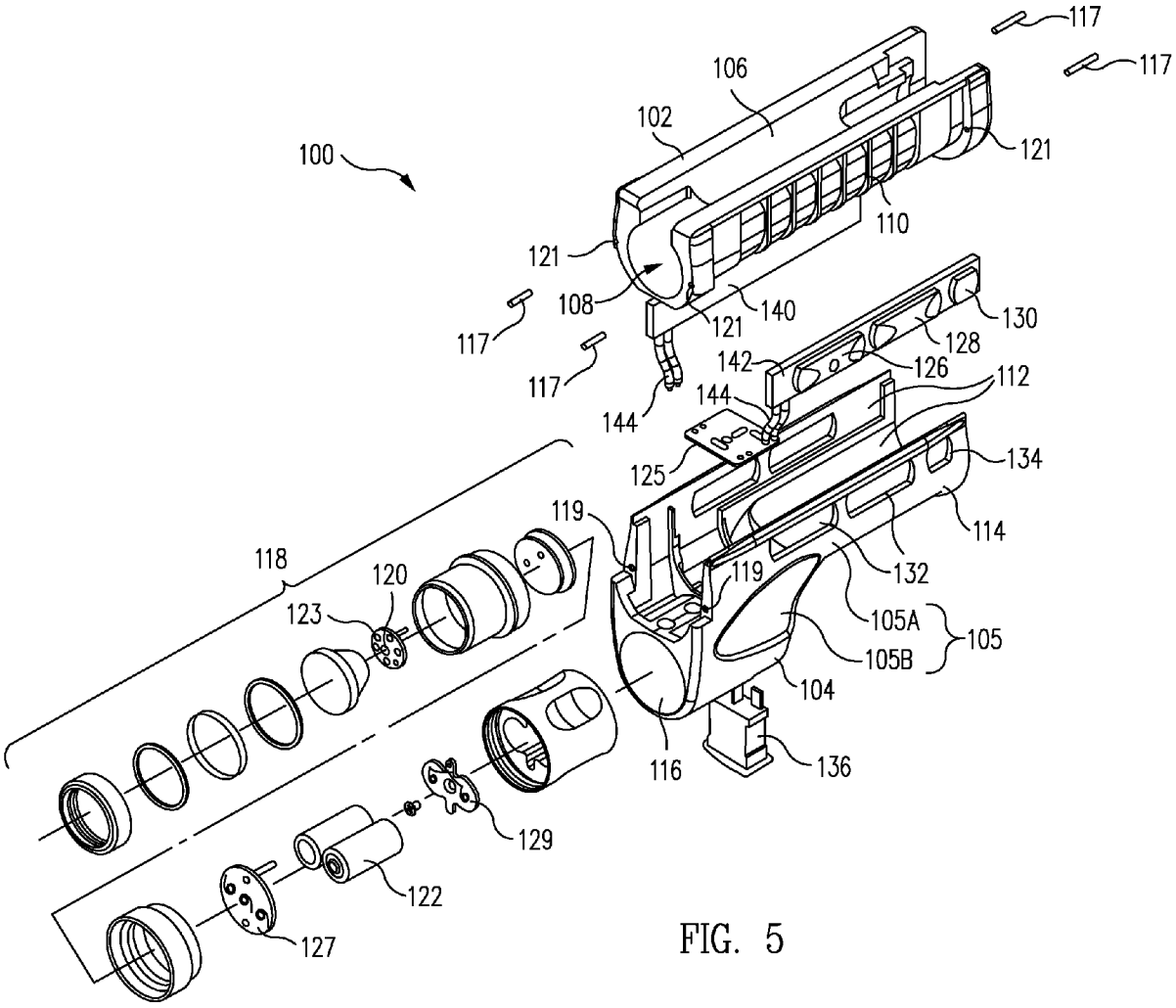
FIG. 5 is an upper, front, left-side, exploded perspective view of the example forend, showing a firearm adapter module and an firearm accessory module thereof.

In addition, as illustrated in FIGS. 4A and 4C, the forend 100 can further comprise a third user operable switch 130 disposed on only one side (e.g., the left side in the particular illustrated embodiments) of the accessory module 104 and configured to adjust one or more operations of the light source 120 in response to a user manipulation thereof. For example, in some embodiments, switch 130 may be used to selectively adjust a light level projected by light source 120 (e.g., a low beam or a high beam). In some embodiments, such operation may be performed while light source 120 has been switched on in a constant fashion after one or both of switches 128 have been operated. Although only one switch 130 is illustrated on the left side of the accessory module 104, switch 130 may be positioned elsewhere (e.g., on the right side of the accessory module 104) and/or additional switches 130 may be provided as desired.

As illustrated in, e.g., FIG. 5, Each of the first and second pairs of switches 126 and 128 and the third switch 130 can be respectively received in correspondingly shaped apertures 132 and 134 disposed in respective ones of the lateral side walls of the accessory module housing 114. Additionally, as illustrated in, e.g., FIGS. 4C, 4E, 4G and 5, in some embodiments, a fourth user operable switch 136 that, for example, plugs directly into the lighting device 118 through a correspondingly shaped aperture 138 in the lower surface of the front end of the accessory module housing 114. In some embodiments, switch 136 may be used to selectively enable or disable lighting device 118 (e.g., operating as a master power switch).

As shown in FIG. 5, lighting device 118 may include various circuit boards 123, 125, 127, and 129, any or all of which may be implemented with appropriate logic circuitry (e.g., a processor with memory configured to execute instructions, hardware-based logic, software-based logic, and/or other logic circuitry) and electrical interconnections to operate and power light source 120 in response to the various switches described herein.

FIGS. 11A-11F are top plan, front end elevation, left side elevation, rear end elevation, bottom plan, and right side elevation views, respectively, of an example embodiment of a plate 140 upon which one each of the corresponding pairs of switches 126 and 128 can be mounted, and which can, for example, be utilized to mount the switches on the right side of the accessory module housing 114 in gang fashion. FIGS. 12A-12F are top plan, front end elevation, left side elevation, rear end elevation, bottom plan, and right side elevation views, respectively, of a plate 142 upon which each of the other ones of the corresponding pairs of switches 126 and 128 and the third switch 130 can be mounted, and which can be utilized, for example to mount those switches on the left side of the accessory module housing 114 in gang fashion.

The plates 140 and 142 can include surface or subsurface electrical conductors that connect to respective ones of the switches 126, 128 and 130, and that terminate in, for example, a multi-conductor "pigtail" 144 which enables the switches to be electrically coupled to circuit board 125. The plates 140 and 142 serve to hold the switches 126, 128 and 130 in a desired alignment for easy assembly of the switches within the accessory module 104, This "modularity," coupled with the easy removability of the accessory module 104 from the adapter module 102, makes access to the accessory portions of the forend 100, e.g., for light source 120 or battery 122 replacement, or for wiring repair, relatively easy, thereby overcoming another drawback of prior art forends.

Further, it should be noted that, by disposing the switches 126 and 128 in corresponding, bilaterally symmetrical pairs on opposite sides of the forend, the switches can be reached by the fingertips of either the right hand or the left hand of a shooter, and in some embodiments may perform the same operation when manipulated by the user, which makes the example forend 100 "ambidextrous," i.e., one in which the lighting device 118 (or other appropriate accessory) can be easily controlled by either a right-handed or left-handed shooter.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A forend for a firearm, comprising:

an elongated adapter module configured to mount below a barrel of the firearm and in front of a receiver of the firearm, the adapter module having a long axis and lower and external side surfaces defining a plug, wherein the lower surface defines a substantially arcuate convex contour;

an elongated accessory module configured to be coupled to the adapter module and comprising an external surface defining a hand grip and upper and internal side surfaces defining an open socket configured to receive the plug in a complementary plug-in engagement and in a direction substantially perpendicular to the long axis of the adapter module, wherein the upper surface defines a substantially arcuate concave contour configured to receive the substantially arcuate convex contour of the in a complementary mating engagement wherein the accessory module comprises a lighting device comprising a light source;

an aperture in a lateral side of the accessory module; and a user operable switch protruding through the aperture and configured to adjust an operation of the light source in response to a user manipulation of the switch.

2. The forend of claim 1, wherein the adapter module comprises a substantially arcuate upper surface that substantially conforms to a portion of a lower surface of the barrel.

3. The forend of claim 1, wherein the adapter module comprises a longitudinal bore configured to receive a tubular magazine of the firearm concentrically therein.

4. The forend of claim 1, wherein:

the adapter module is a first adapter module;

the firearm is a first firearm; and the accessory module is configured to be coupled to at least one surface of a second adapter module configured differently from the first adapter module and to mount below a barrel and in front of a receiver of a second firearm configured differently from the first firearm.

5. The forend of claim 4, further comprising the second adapter module.

6. The forend of claim 1, wherein the accessory module is coupled to the adapter module by an adhesive.

7. The forend of claim 1, wherein the accessory module is releasably coupled to the adapter module.

8. The forend of claim 7, further comprising a plurality of fasteners configured to releasably couple the accessory module to the adapter module, wherein at least one of the fasteners comprises a roll pin.

9. The forend of claim 1, wherein at least one of the adapter module and the accessory module comprises a molded plastic.

10. The forend of claim 1, wherein the firearm is a shotgun.

11. A forend for a firearm, comprising:

an elongated adapter module configured to mount below a barrel of the firearm and in front of a receiver of the firearm, the adapter module having a long axis and lower and external side surfaces defining a plug;

an elongated accessory module configured to be coupled to the adapter module and comprising an external surface defining a hand grip and upper and internal side surfaces defining an open socket configured to receive the plug in a complementary plug-in engagement and in a direction substantially perpendicular to the long axis of the adapter module, wherein the accessory module comprises a lighting device comprising a light source; and first and second user operable switches disposed on first and second lateral sides of the accessory module and disposed in substantially symmetrical alignment with each other in relation to a longitudinal axis of the accessory module, each switch being configured to adjust an operation of the light source in response to a user manipulation thereof.

12. The forend of claim 11, wherein:

the operation is a first operation;

the forend further comprises a third user operable switch disposed on the first lateral side of the accessory module and configured to adjust a second operation of the light source in response to a user manipulation of the third switch; and a surface of the second lateral side is disposed in substantially symmetrical alignment with the third switch.

13. A method, comprising:

installing an elongated adapter module on a firearm, the adapter module being configured to mount below a barrel of the firearm and in front of a receiver thereof, and having a long axis and lower and external side surfaces defining a plug;

coupling an elongated accessory module to the adapter module, wherein the coupling comprises sliding the plug into the socket in a direction substantially perpendicular to the long axis of the adapter module; and wherein the accessory module comprises:

an external surface defining a hand grip and upper and internal side surfaces defining an open socket configured to receive the plug in a complementary plug-in engagement, a lighting device comprising a light source, an aperture disposed in a lateral side of the accessory module, and a user operable switch protruding through the aperture and configured to adjust an operation of the light source in response to a user manipulation thereof.

14. The method of claim 13, wherein the adapter module comprises a substantially arcuate upper surface that substantially conforms to a portion of a lower surface of the barrel.

15. The method of claim 13, wherein the adapter module comprises a longitudinal bore configured to receive a tubular magazine of the firearm concentrically therein.

16. The method of claim 13, wherein:

the adapter module is a first adapter module;

the firearm is a first firearm; and the method further comprises:

decoupling the accessory module from the first adapter module, and coupling the accessory module to at least one surface of a second adapter module configured differently from the first adapter and to mount below a barrel and in front of a receiver of a second firearm that is configured differently from the first firearm.

17. The method of claim 13, wherein the coupling comprises affixing the accessory module to the adapter module by an adhesive.

18. The method of claim 13, wherein the coupling comprises releasably coupling the accessory module to the adapter module.

19. The method of claim 13, wherein the accessory module is coupled to the adapter module by a plurality of fasteners, at least one of the fasteners comprising a roll pin.

20. The method of claim 13; wherein at least one of the adapter module and the accessory module comprises a molded plastic.

21. The method of claim 13, wherein the firearm is a shotgun.

22. A method, comprising:

installing an elongated adapter module on a firearm, the adapter module being configured to mount below a barrel of the firearm and in front of a receiver thereof; and having a long axis and lower and external side surfaces defining a plug;

coupling an elongated accessory module to the adapter module, wherein the coupling comprises sliding the plug into the socket in a direction substantially perpendicular to the long axis of the adapter module; and wherein the accessory module comprises:

an external surface defining a hand grip and upper and internal side surfaces defining an open socket configured to receive the plug in a complementary plug-in engagement, a lighting device comprising a light source, and first and second user operable switches disposed on first and second lateral sides of the accessory module and disposed in substantially symmetrical alignment with each other in relation to a longitudinal axis of the accessory module, each switch being configured to adjust an operation of the light source in response to a user manipulation thereof.

23. The method of claim 22, wherein:

the operation is a first operation;

the accessory module comprises a third user operable switch disposed on the first lateral side of the accessory module and configured to adjust a second operation of the light source in response to a user manipulation thereof; and a surface of the second lateral side is disposed in substantially symmetrical alignment with the third switch.

24. A method, comprising:

operating a forend for a firearm having a barrel and a receiver, the forend comprising:

an elongated adapter module mounted below the barrel and in front of the receiver, the adapter module having a long axis and lower and external side surfaces defining a plug, wherein the lower surface defines a substantially arcuate convex contour; and an elongated accessory module coupled to the adapter module and comprising:

an external surface defining a hand grip and upper and internal side surfaces defining an open socket configured to receive the plug in a complementary plug-in engagement and in a direction substantially perpendicular to the long axis of the adapter module, wherein the upper surface defines a substantially arcuate concave contour configured to receive the substantially arcuate convex contour of the plug in a complementary mating engagement, a lighting device comprising a light source, an aperture in a lateral side of the accessory module, a user operable switch protruding through the aperture and configured to adjust an operation of the light source in response to a user manipulation of the switch, and the operating comprises manipulating the switch.

25. The method of claim 24, wherein the adapter module comprises a substantially arcuate upper surface that substantially conforms to a portion of a lower surface of the barrel.

26. The method of claim 24, wherein the adapter module comprises a longitudinal bore configured to receive a tubular magazine of the firearm concentrically therein.

27. A method, comprising:

operating a forend for a firearm having a barrel and a receiver, the forend comprising:

an elongated adapter module mounted below the barrel and in front of the receiver, the adapter module having a long axis and lower and external side surfaces defining a plug; and an elongated accessory module coupled to the adapter module and comprising:

an external surface defining a hand grip and upper and internal side surfaces defining an open socket configured to receive the plug in a complementary plug-in engagement and in a direction substantially perpendicular to the long axis of the adapter module, a lighting device comprising a light source, first and second user operable switches disposed on first and second lateral sides of the accessory module and in substantially symmetrical alignment with each other in relation to a longitudinal axis of the accessory module, each switch is configured to adjust an operation of the light source in response to a user manipulation thereof, and the operating comprises manipulating at least one of the switches.

28. The method of claim 27, wherein the first and second switches perform the same operation of the light source to permit ambidextrous use of the lighting device.

29. The method of claim 27, wherein:

the operation is a first operation;

the accessory module comprises a third user operable switch disposed on the first lateral side of the accessory module and configured to adjust a second operation of the light source in response to a user manipulation of the third switch;

a surface of the second lateral side is disposed in substantially symmetrical alignment with the third switch; and the operating further comprises manipulating the third switch.

30. The method of claim 24, wherein at least one of the adapter module and the accessory module comprises a molded plastic.

31. The method of claim 24, wherein the firearm is a pump-action shotgun.

32. The method of claim 31, wherein the operating comprises:

gripping the hand grip; and pumping the shotgun.

* * * * *